US008599072B2

(12) United States Patent
Reed et al.

(10) Patent No.: US 8,599,072 B2
(45) Date of Patent: Dec. 3, 2013

(54) ANTENNAS

(75) Inventors: Christopher Reed, Hitchin (GB); Simon Bates, Saffron Walden (GB); Graham Dolman, Saffron Walden (GB); David Adams, Chelmsford (GB); William Waddoup, Harlow (GB); Dean Kitchener, Brentwood (GB)

(73) Assignee: Apple Inc., Cupertino, CA (US)

( * ) Notice: Subject to any disclaimer, the term of this patent is extended or adjusted under 35 U.S.C. 154(b) by 886 days.

(21) Appl. No.: 12/136,240

(22) Filed: Jun. 10, 2008

(65) Prior Publication Data

US 2009/0303135 A1 Dec. 10, 2009

(51) Int. Cl.
*H01Q 1/24* (2006.01)

(52) U.S. Cl.
USPC ..... 343/702

(58) Field of Classification Search
USPC ..... 343/702
See application file for complete search history.

(56) References Cited

U.S. PATENT DOCUMENTS

| | | | | |
|---|---|---|---|---|
| 5,724,049 | A | 3/1998 | Parak et al. | |
| 5,986,519 | A | 11/1999 | Kellett | |
| 6,512,491 | B2 * | 1/2003 | Kanayama et al. | 343/883 |
| 6,774,856 | B2 | 8/2004 | Back et al. | |
| 7,050,007 | B2 | 5/2006 | Akiho et al. | |
| 7,345,632 | B2 | 3/2008 | Smith | |
| 7,501,983 | B2 * | 3/2009 | Mikkola | 343/700 MS |
| 2003/0189516 | A1 * | 10/2003 | Olson | 343/700 MS |
| 2004/0145527 | A1 * | 7/2004 | Mikkola | 343/700 MS |
| 2006/0244663 | A1 | 11/2006 | Fleck et al. | |

FOREIGN PATENT DOCUMENTS

| | | |
|---|---|---|
| EP | 1 699 109 | 9/2006 |
| WO | WO-02/067377 A1 | 8/2002 |
| WO | WO-2004/070878 A1 | 8/2004 |

OTHER PUBLICATIONS

Löffler, "Low Cost-Cost X-polarised Broadband PCS antenna with low cross-polarisation level", Electronics Letters, Sep. 30, 1999, vol. 35, No. 20, pp. 1689-1691.
Partial search report in EP09162416.3, dated Sep. 17, 2009.
Extended search report in EP09162416.3, dated Mar. 23, 2010.
First Office Action and translation thereof in Chinese Patent Application No. 200910149219.7, Mar. 4, 2013, pp. 1-13.

* cited by examiner

*Primary Examiner* — Hoang V Nguyen
*Assistant Examiner* — Kyana R McCain
(74) *Attorney, Agent, or Firm* — Meyertons, Hood, Kivlin, Kowert & Goetzel, P.C.

(57) ABSTRACT

A broadband antenna structure has an electrically conductive enclosure with a closed end, over which a non-electrically conductive cover is placed. A radiating portion of an antenna feed layer comprising a conductive patch antenna element is placed in between the enclosure and the cover. The patch antenna element design is inherently broader band than that of conventional cavity-backed slot-radiating antennas, which are constrained in bandwidth by the need to keep the cavity formed in the enclosure small. The dielectric constant of the dielectric material of the cover reduces the required size of the conductive antenna element. The broadband antenna structure may be connected with an electronic device to form an antenna arrangement in which a portion of the antenna feed layer extends through an opening in a surface of an antenna housing, the portion being within an electronic device enclosure of the electronic device.

32 Claims, 13 Drawing Sheets

ANTENNAS

FIELD OF THE INVENTION

The present invention relates to a broadband antenna structure and an antenna arrangement comprising the antenna structure and an electronic device, and is particularly, but not exclusively, suited to physically connecting an electronic device onto an exterior surface of an antenna and providing electrical coupling between the antenna and its associated control electronics.

BACKGROUND OF THE INVENTION

Antennas are transducers designed to transmit or receive electromagnetic waves. Those used at cellular communications base stations are commonly located on top of buildings, towers or masts to maximise or control the geographic coverage area of the system. The antennas are typically connected with electronic devices such as amplifiers, filters, transceivers etc via one or more coaxial cables. To ease maintenance and historically because of their size, the electronic devices connected to the antennas are conventionally housed remotely from the antennas and are positioned on the ground or in a building. This arrangement has a number of drawbacks which include the high cost of coaxial cables of this type, the RF losses introduced by the cables which can compromise the system performance, possible failure of the cables or the connectors used to attach them to the antennas and equipment, passive inter-modulation distortion due to metal-to-metal contact in the connectors, lease costs associated with the space that the cables occupy, and lease costs associated with the large footprint of the building or of the cabinet housing the electronic device.

As is known, antennas include a feed layer comprising a radiating portion and a feed network. The feed layer in conventional arrangements is located inside the housing or radome of the antenna so as to protect the feed layer from the effects of environmental exposure including rain, wind, sand, UV, ice, etc, and mechanical damage. Such an arrangement is known from the applicant's co-pending U.S. patent application Ser. No. 11/966,501, which describes a cavity-backed, slot-radiating type antenna. In this arrangement, an electrically conducting enclosure has an open or partially open end and a cover. The cover is configured with a slot which is positioned over the resonant cavity formed by the enclosure. The resonance cavity is then excited by or excites the feed layer located in between the enclosure and the cover, such that the higher the volume of the cavity, the greater the bandwidth that can be achieved. This arrangement is however constrained in bandwidth by the need to keep the cavity in the enclosure small, so that the sub-arrays may be arranged in an array at substantially half-wavelength spacing that is required for multi-element array antennas. Furthermore, this slot antenna design requires separate slots for each polarisation.

It would be desirable to provide a broadband antenna with reduced cost and weight that can be connected with (and removed from) an electronic device easily and preferably with the aim of avoiding at least some of the disadvantages associated with connecting an antenna with a remotely located electronic device as described above.

SUMMARY OF THE INVENTION

In accordance with a first aspect of the present invention, there is provided an antenna arrangement comprising:

an antenna, said antenna comprising an antenna housing and a feed layer, said antenna housing having a surface and said surface comprising an opening; and an electronic device, said electronic device comprising an electronic device housing, wherein a portion of the feed layer protrudes outside of the antenna housing through the opening, said outside portion being within the electronic device housing of the electronic device.

Connecting the electronic device directly to the antenna according to embodiments of the invention reduces the amount of coaxial cables needed or eliminates the need for coaxial cables completely. As a result the costs associated with coaxial cables, the RF losses introduced by the cables which can compromise the system performance, possible failure of the cables, lease costs for the space the cables occupy and lease costs for large footprint of the building or cabinet housing the electronic device are substantially reduced or eliminated.

Whilst, as described above, it is normally not desirable to extend a portion of the feed layer outside of the antenna enclosure housing, configuring the feed layer in this way has the advantage of facilitating direct coupling between the feed layer and the electronic device track. Embodiments of the invention ensure feed layer protection by locating the outside portion of the feed layer within the electronic device housing of the electronic device which is connected with the antenna.

In embodiments of this aspect of the invention, the electronic device comprises an electrically conductive track, and the electronic device track is coupled to the feed layer of the antenna. In one arrangement, the electronic device track is coupled to the feed layer of the antenna by means of broadside coupling, preferably an overlay coupling. Using an overlay coupling instead of conventional connectors eliminates possible failure, losses and costs associated with the connectors and passive inter-modulation distortion due to metal-to-metal contact in the connectors.

In a preferred arrangement, the overlay coupling comprises two dielectric substrates, the feed layer being printed on a surface of one dielectric substrate, and the electronic device track being printed on a surface of the other dielectric substrate, wherein said two substrates are positioned such that a section of the feed layer is in registration with a section of the electronic device track.

Printing the feed layer and the electronic device track on two separate substrates means that the feed layer of the antenna and the electronic device track are not permanently connected and are thus easily separable, which simplifies maintenance and assembling of the antenna arrangement.

The aforementioned coupling of the feed layer and the electronic device by means of overlay coupling requires bringing the feed layer of the antenna and the electronic device track close together. This can be difficult to achieve in practice. The first difficulty to overcome is that, since the electronic device is normally populated with electronic components, it is not naturally in close enough proximity to the antenna feed layer. Secondly, the antenna feed layer outside the antenna enclosure may be at right angles to that of the electronic device track. Thirdly the antenna may use a triplate structure whereas the electronic device track is likely to use microstrip structure in the coupling region. Further aspects of the present invention address these problems.

The first problem is partly solved by extending only a portion of the feed layer outside of the antenna enclosure and bringing only this portion of the feed layer close to the electronic device track.

In some embodiments of the invention, the electrically conductive enclosure is substantially U-shaped and the feed layer is formed around an outer surface of the enclosure. The enclosure has a closed end without an opening and, unlike the prior art, slots are not provided in the enclosure. The enclosure can therefore be made of a continuous sheet of material which can be formed using an extrusion process or a folding process from a continuous sheet of material, both of which are relatively cheap and easy compared to the moulding process used in the prior art.

One advantage of the enclosure being substantially U-shaped is that it readily allows different track-to-ground-plane spacings to be used in the distribution network and microstrip patch antenna sections. Small ground plane spacings are advantageous for the distribution network as they allow narrow line widths to be used for the impedances typically required in such a network, while large ground plane spacings beneath the patch elements allow broadband element designs to be implemented. The transition from one type of spacing to another can conveniently occur at the corners of the U shaped enclosure.

In a preferred arrangement, the feed layer is substantially U-shaped so as to wrap around the corresponding U-shaped electrically conductive enclosure. This is desirable, especially when multiple dual polarization sub-arrays are provided, because U-shaped feed layers facilitate a simple dual polarized sub-array construction and simplifies the alignment of a plurality of closely spaced sub-arrays.

In one embodiment of the invention, the feed layer comprises a plurality of patch antenna elements, and is printed on a dielectric substrate. The use of patch antenna elements instead of a cavity-backed, slot-radiating type used in the prior art provides an increase in broadband performance.

In embodiments of the invention, the antenna comprises a ground plane for the feed layer within the antenna housing, and the electronic device comprises a ground plane for the electronic device track. In this arrangement, part of the portion of the feed layer extending outside of the antenna has a ground plane, which is electrically coupled to both the ground plane of the antenna and the ground plane of the electronic device. This arrangement provides a continuous ground plane for the feed layer inside and outside the antenna housing thus allowing a continuous transmission line. This in part solves the problem that the antenna uses a triplate structure whereas the electronic device track uses microstrip structure in the coupling region.

In accordance with another aspect of the present invention, there is provided a method for connecting an electronic device with an antenna according to the appended claims.

In accordance with another aspect of the present invention, there is provided an antenna arrangement comprising:

an electrically conductive enclosure and a feed layer thereon, wherein the feed layer comprises a first electrically conductive track;

an electronic device, said electronic device comprising a second electrically conductive track; and a substrate arranged to secure a section of the first electrically conductive track in registration with a section of the second electrically conductive track so as to facilitate electromagnetic coupling therebetween.

As mentioned above, using an overlay coupling instead of conventional connectors eliminates possible failure, losses and costs associated with the connectors and passive intermodulation distortion due to metal-to-metal contact in the connectors.

In accordance with another aspect of the present invention, there is provided an antenna comprising:

an electrically conductive enclosure;

an non-electrically conductive layer comprising a portion covering at least part of a closed end of the enclosure; and a feed layer located between the enclosure and said portion of the non-electrically conductive layer, the feed layer comprising a conductive antenna element and an electrically conductive track, wherein said radiating portion and said portion of the non-electrically conductive layer provide a radiating element, and said radiating element is at least part aligned with the closed end.

In one arrangement, the conductive antenna element is a conductive patch antenna element.

The advantage of embodiments of this aspect of the invention is that the radiating element is inherently broader band (approx 25% of centre frequency compared to approx 15%) than are prior art antennas. The design described in U.S. patent application having U.S. patent application Ser. No. 11/966,501 is constrained in bandwidth by the need to keep the cavity formed in the enclosure small, so that the column elements may be arranged in an array at substantially half-wavelength spacing. Antennas according to an embodiment of the invention suffer less compromise in terms of bandwidth in achieving the same size constraint.

This is achieved in part by the dielectric constant of the dielectric material of the non-electrically conductive cover reducing the required size of the conductive antenna element, compared to the size that would be required if the radiating portion were covered with a material with the dielectric constant of air. Another factor that affects the achievable bandwidth is the spacing between the electrically conductive enclosure and the feed layer, together with the dielectric beneath the patch antenna elements. In embodiments of the invention, there is a relatively large ground plane spacing between the middle surface of the electrically conductive enclosure and the feed layer, and the region beneath the patch antenna elements comprises an essentially air dielectric. This configuration affords the antenna a greater bandwidth of operability.

Unlike conventional arrangements, the bandwidth is not constrained by the volume occupied by the cavity formed by the enclosure because the resonance structure, which is excited by or excites the feed layer, is provided by the gap between the ground plane, i.e. the middle surface of the electrically conductive enclosure, and the feed layer, instead of a cavity in the present invention. In fact, using patch antenna elements as conductive antenna elements eliminates the need for a cavity completely, or enables the cavity to be filled, for example by an electronic device such as a beam former.

Preferably, the feed layer comprises the electrically conductive track and the feed layer is printed on a single substrate. The use of a single substrate reduces the cost and complexity of the design. The integrated feed network technology is also designed to permit ready integration of other RF elements that might for example be part of an integrated masthead cellular base station design, within the antenna housing.

Preferably, the enclosure comprises two closed sides, each side having two end portions, wherein one of said end portions of a first closed side is joined to one of the end portions of a second closed side by the closed end of the enclosure. Preferably, the enclosure also comprises two open sides and an open end.

Preferably the antenna comprises an electrically conductive layer covering, or providing, at least part of a closed side of the enclosure in the form of a ground plane. This ground plane forms an enclosed triplate transmission region which results in a well controlled distribution circuit and minimizes radiated and received interference. In addition, this isolates adjacent feed networks of adjacent sub-arrays and thereby minimizes interference between adjacent feed networks of different sub-arrays. In one embodiment, the triplate region is substantially air space e.g. by means of foam spacers so as to reduce costs.

In one embodiment, the antenna comprises a dielectric spacer between said closed end of the enclosure and the radiating portion. Preferably, the dielectric spacer is arranged to separate the feed layer from said closed end of the enclosure by a distance greater than a distance between said feed layer and a said closed side of the enclosure.

In one arrangement, the closed end can be provided by two sides.

In one embodiment a sub-array is implemented as a multi-antenna array, comprising:

a further electrically conductive enclosure, the further electrically conductive enclosure and the electrically conductive enclosure being located on two opposite sides of the electrically conductive layer, wherein the electrically conductive layer covering at least part of a closed side of the further electrically conductive enclosure;

a further non-electrically conductive layer comprising a portion covering at least part of a closed end of the further enclosure; and a further feed layer located between the further enclosure and said portion of the further non-electrically conductive layer, the further feed layer comprising a further radiating portion comprising a conductive antenna element, wherein said further radiating portion and said portion of the further non-electrically conductive layer provide a further radiating element, and at least part of said further radiating element is aligned with the closed end.

In one arrangement, the conductive antenna element is a conductive patch antenna element. In another arrangement, the non-electrically conductive layer and the further non-electrically conductive layer are provided as a single non-electrically conductive layer. Preferably, the further feed layer is located between the further enclosure and the electrically conductive layer.

In a dual polarized antenna embodiment, there is also provided:

a further electrically conductive cover covering at least part of the second side of the enclosure, wherein the feed layer comprises two electrically conductive tracks, a first of the two tracks extending between the first side of the enclosure and the electrically conductive cover covering at least part of the first side, and a second of the two tracks extending between the second side of the enclosure and the further electrically conductive cover.

Another advantage of embodiments of this aspect of the invention is that the conductive antenna elements combine two polarisation elements in one patch, as opposed to the previous slot antenna design that required separate slots for each polarisation. As a result, a dual polarised vertical column sub-array with a given number of elements may be somewhat shorter in length. Furthermore, each polarization element is allotted almost twice the length along the longitudinal axis of the sub-array that would be allocated in the previous slot antenna design, allowing greater design freedom.

Further features and advantages of the invention will become apparent from the following description of preferred embodiments of the invention, given by way of example only, which is made with reference to the accompanying drawings.

Figure 1:
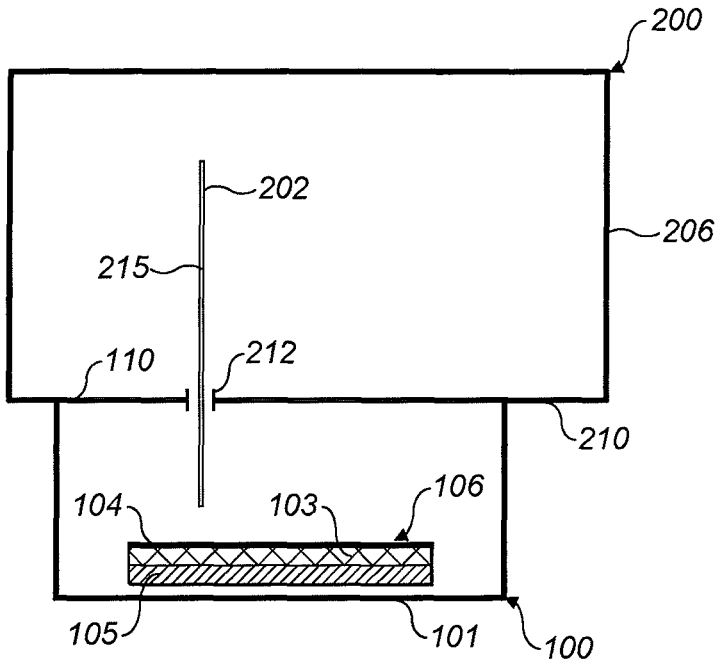
FIG. 1 is a schematic diagram showing an antenna arrangement comprising a single polarized stand-alone single sub-array antenna and an electronic device according to an embodiment of the invention.

Several parts and components of the invention appear in more than one Figure; for the sake of clarity the same reference numeral will be used to refer to the same part and component in all of the Figures. In addition, certain parts are referenced by means of a number and one or more suffixes, indicating that the part comprises a sequence of elements (each suffix indicating an individual element in the sequence). For clarity, when there is a reference to the sequence per se the suffix is omitted, but when there is a reference to individual elements within the sequence the suffix is included.

DETAILED DESCRIPTION OF THE INVENTION

As described above, embodiments of the invention are concerned with physically connecting an electronic device with an antenna to overcome some or all of the disadvantages associated with connecting an antenna with a remotely located electronic device. Specifically, embodiments of the invention provide a novel arrangement of an antenna structure and electronic components which interface with the antenna structure so as to input and output signals transceived therefrom.

In particular, embodiments of the invention are concerned with physically connecting an electronic device onto an exterior surface of an antenna and coupling an electrically conductive track of the electronic device with a feed layer of the antenna outside the antenna housing but inside the electronic device enclosure, preferably without metal-to-metal contact, thus minimizing passive inter-modulation distortion, reducing losses, increasing reliability and reducing cost.

The antenna in embodiments of this invention can form either a sub-array within a multi-element array antenna, or a stand-alone single-element or single sub-array antenna. A single sub-array can be used to form an antenna in its own right, for example suitable for use as a conventional tri-sectored masthead cellular base station antenna. A multi-element array antenna may be desirable for higher capacity and higher coverage cellsite antenna systems. Examples of an electronic device which may be desirably connected to the antenna in accordance with embodiments of the invention include an azimuth beam former, an amplifier or a transceiver.

Turning to FIG. 1, a first embodiment of the invention, hereinafter referred to as an antenna arrangement, will now be described. The antenna arrangement comprises an antenna 200 and an electronic device 100 connected thereto.

The electronic device 100 comprises an electronic device enclosure 101 and an electrically conductive track 104 therein. The electronic device enclosure 101 is shown in FIG. 1 to be rectangular, and whilst other shapes are possible, the enclosure 101 preferably has a substantially flat outer surface 110 in the region of physical connection to the antenna 200. The electronic device track 104 may for example be embodied as part of an Application-specific integrated circuit (ASIC) or a discrete track 104 within an electronic device enclosure 101, in which case it is printed on a surface of a dielectric substrate, e.g. a film or a solid substrate. A ground plane is preferably attached to another surface of the dielectric substrate. In this embodiment, the track 104 is carried by a printed circuit board (PCB).

The antenna 200 comprises an antenna housing 206 and a feed layer 202. The antenna housing has a surface 210 onto which the electronic device 100, specifically the outer surface 110, is connected. The surface 210 comprises an opening 212 through which a portion 201 of the feed layer extends outside of the antenna housing into the electronic device enclosure 101.

The antenna housing 206 such as a radome comprises a non-electrically conductive material, e.g. plastic or fiberglass. The material preferably allows a relatively unattenuated electromagnetic signal transmission between the antenna inside the antenna housing and outside equipment. The antenna housing 206 is shown to be rectangular; however other shapes are possible although the outer surface 210 onto which the electronic device is connected is preferably substantially flat.

The opening 212 in the surface 210 is arranged such that is big enough to allow a portion 201 of the feed layer to extend through but is preferably small enough to prevent undesirable movement of the feed layer once extended into the electronic device enclosure 101, to avoid weakening the carrier structure of the cover 220 unnecessarily, and to ensure that the cover 220 is as electrically continuous as possible to ensure a continuous ground plane structure. The opening 212 is preferably confined within the surface area 110 of the electronic device 100 which is connected to the surface 210 of the antenna 200, so that the antenna 200 and the portion 201 of the feed layer 202 is sealed against water and other environmental conditions.

The feed layer 202 is printed on a dielectric substrate which is preferably at least partly flexible. In this embodiment, the feed layer 202 is printed on a single film layer 215. A film is chosen over a solid dielectric substrate since it is likely to reduce cost, simplify the mechanical design and have a better high frequency performance.

Figure 2:
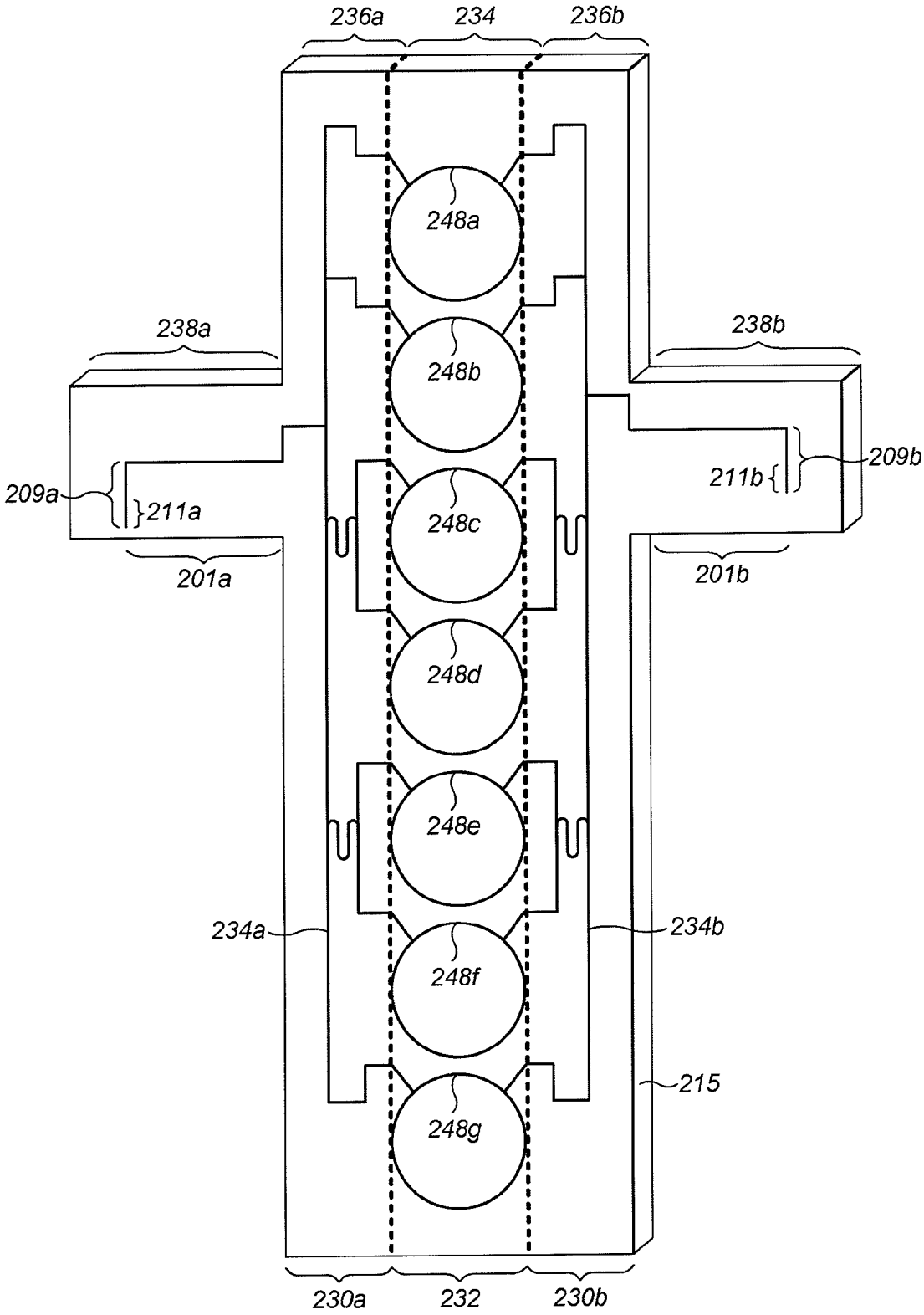
FIG. 2 is a schematic diagram showing a dual polarized feed layer printed on a film layer.

The feed layer 202 comprises an array of conductive antenna elements 248 and one or more feed distribution networks 234*a*, 234*b*, each feed distribution network comprising one or more feed lines for every conductive antenna element as shown in FIG. 2, each feed line being an electrically conductive track. The conductive antenna elements 248 of the feed layer 202 transceive electromagnetic waves and are fed by the common feed network 234*a*, 234*b*. The feed distribution network 234*a*, 234*b* is preferably designed to exhibit a suitable characteristic impedance to match other parts of the feed network; typically 50 Ohms is used.

Figure 15:
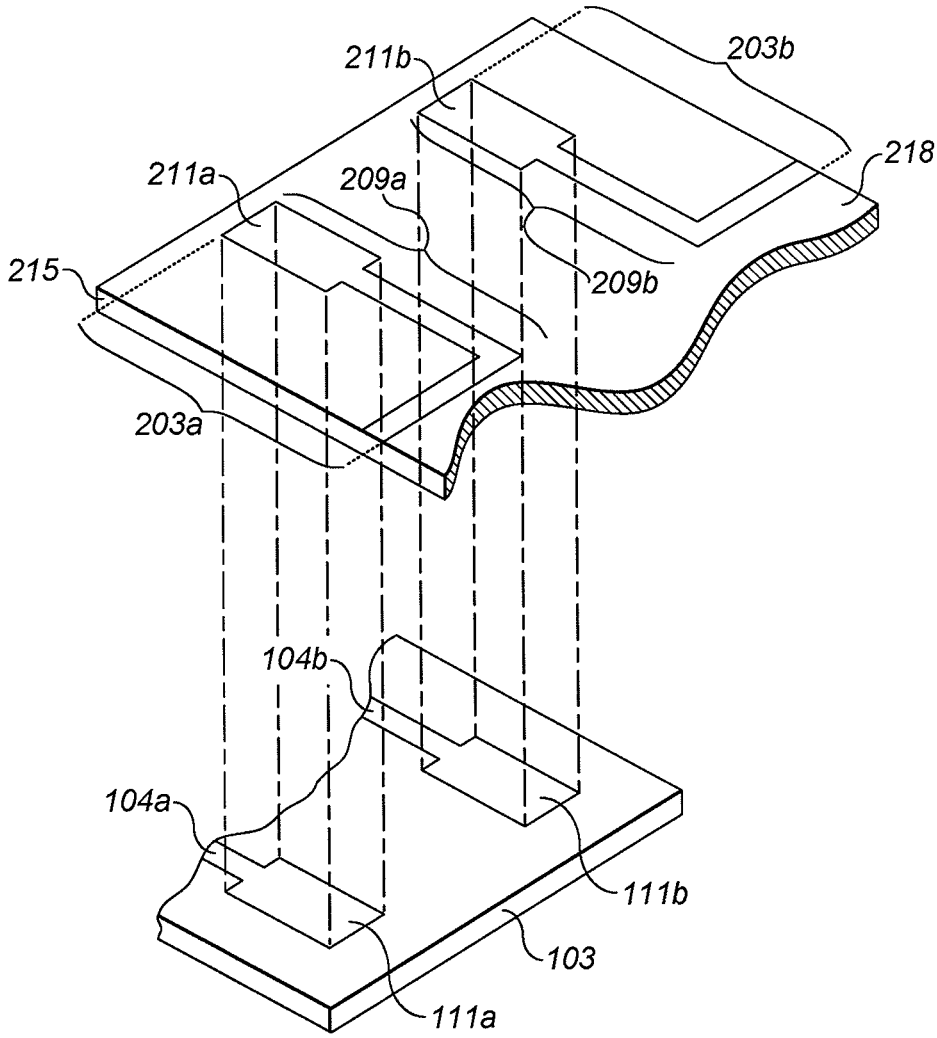
FIG. 15 is a schematic diagram showing two piece overlay coupling between a feed layer of a dual polarized antenna and two electronic device tracks of an electronic device according to an embodiment of the invention.

The feed lines for all conductive antenna elements 248 are combined and a resulting track extends away from the feed network, orthogonal to the length of the feed layer 202. As described above, a portion 201 of this resulting track then extends outside of the antenna housing 206, and is coupled to a section 111 of an electrically conductive track 104 of the electronic device 100 as shown in FIG. 15.

Figure 3:
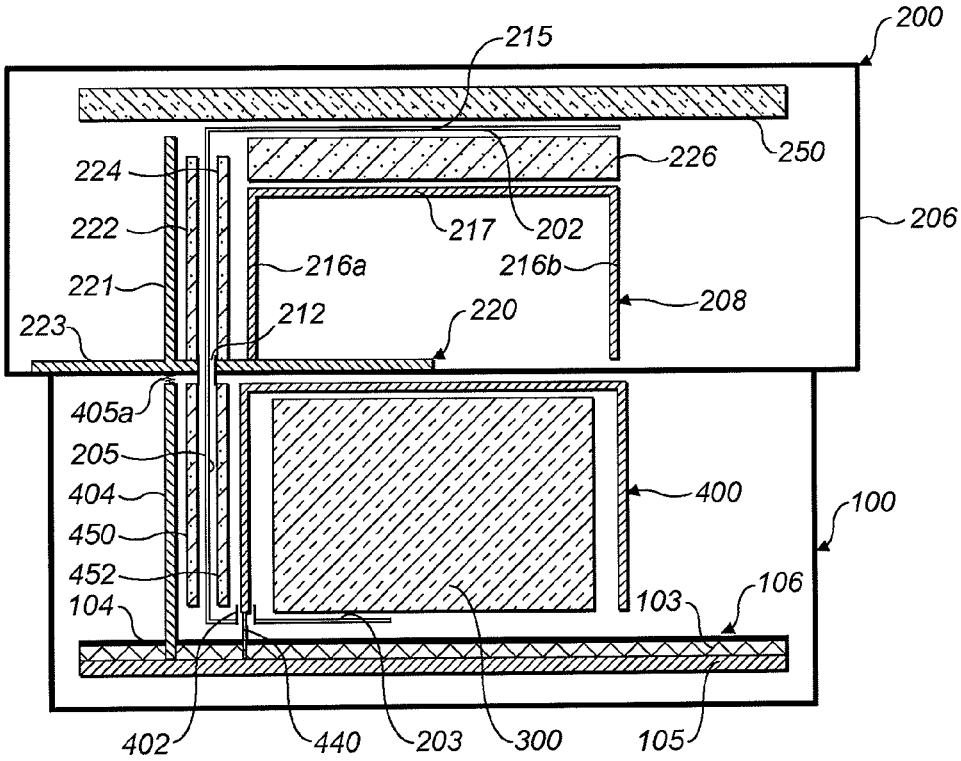
FIG. 3 is a schematic diagram showing more detailed construction of an antenna arrangement of FIG. 1.

As shown in FIG. 3 two ground planes 216, 221 are provided for at least the feed network regions of the feed layer along the side surfaces 216*a*, 216*b* of the enclosure 208 inside the antenna housing, thereby forming an enclosed triplate transmission region which results in a well controlled distribution circuit and minimizes radiated and received interference.

The feed layer 202 may be located between the two ground planes by means of mechanical spacers (not shown) such that the dielectric surrounding the feed layer is air. Alternatively, as shown in FIG. 3, a dielectric material such as foam, preferably in the form of a sheet 222, 224, can be positioned between the feed layer and the two ground planes 216, 221 respectively in order to locate the feed layer 202. The function of the dielectric layer is to locate the feed layer relative to the ground planes, in particular so as to maintain the distance therebetween. In terms of radio frequency performance, the two approaches are similar since the dielectric properties of foam are typically very similar to those of air.

Figure 4:
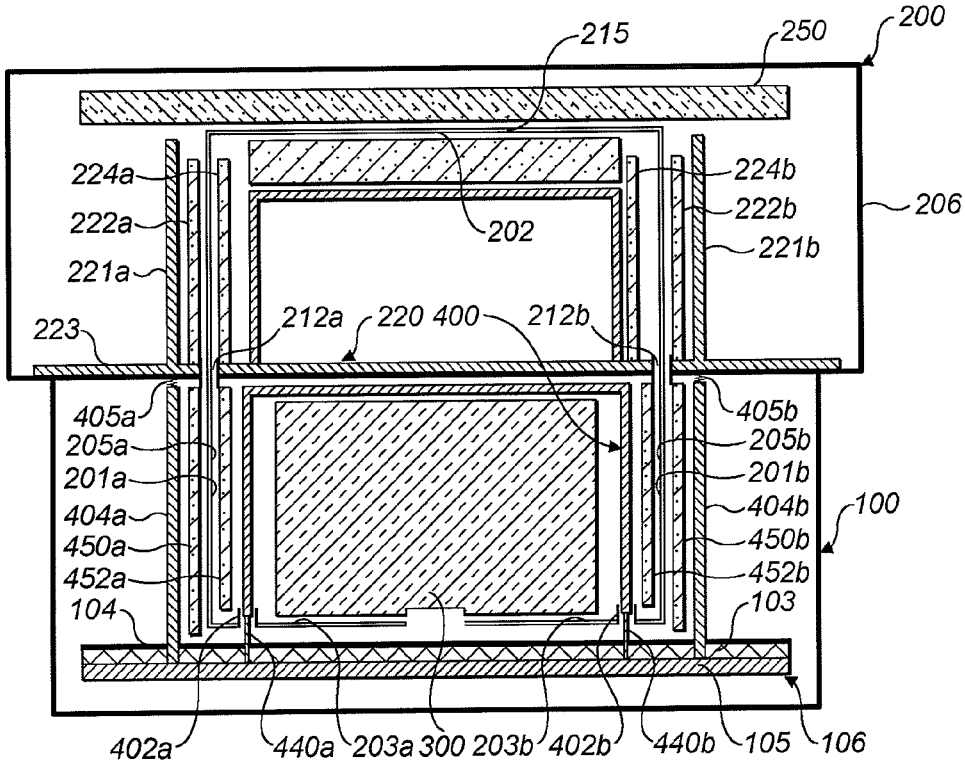
FIG. 4 is a schematic diagram showing a dual polarized embodiment of an antenna arrangement of FIG. 3.

In this embodiment, a first ground plane 216 is conveniently provided by an electrically conductive enclosure 208, which also provides mechanical support for the feed layer and a second 221 by an electrically conductive cover 220, which conveniently carries the enclosure 208 and the feed layer 202 wrapped around the enclosure 208. In this embodiment, the enclosure 208 is substantially U-shaped. The U-shaped structure is preferably mounted on or otherwise attached to the same surface 210 which is connected to the electronic device 100 but from inside of the antenna housing 206. The U-shaped enclosure 208, around part or all of the outer surface of which the feed layer 202 is wrapped, comprises a middle surface and two side surfaces, the angle between the middle surface and either of the two side surfaces being preferably 90 degrees. Wrapping the feed layer around the electrically conductive enclosure 208 forms a substantially U-shaped feed layer as shown in FIG. 4 comprising a corresponding middle portion 232 comprising the conductive antenna elements 248, and two corresponding side portions 230*a*, 230*b* each comprising a feed network. Alternatively the feed layer can be wrapped around the middle surface of the electrically conductive enclosure 208 and only one side surface of the enclosure 208 forming a V-shaped feed layer as shown in FIG. 3. In either case, to ease the wrapping process, the feed layer substrate 215 is flexible at least around the corners of the enclosure 208 or is non flexible around the corners but is of a corresponding shape similar to that of the enclosure 208.

When supported in this manner by the enclosure 208, the portion 201 of the feed layer 202 extends outside the antenna housing 206 and is coupled to the electronic device track 104 inside the electronic device enclosure 101.

The coupling might be achieved for example using a known radio frequency (RF) connector or any other suitable means. RF connectors introduce loss which degrades the receiver noise figure and reduces transmitted power. In the case of the receiver this impairs the system link budget; in the case of the transmitter it can either impact the link budget or require the transmitter to have a more powerful (and hence more expensive) power amplifier. Furthermore RF connectors and the associated jumper cables are expensive. It is therefore desirable to remove these from the system to reduce equipment costs. Since RF connectors and the associated jumper cables are a cause of system failures, it is desirable to remove these from the system to improve reliability and reduce operating expenses.

Figure 6A:
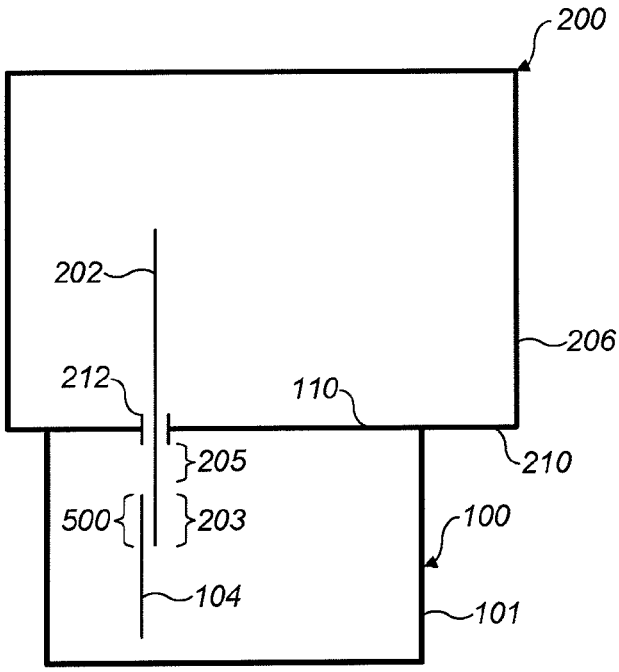
FIG. 6A is a schematic diagram showing coupling between a feed layer of an antenna and an electronic device track of an electronic device inside the electronic device enclosure without folding the feed layer.
Figure 6B:
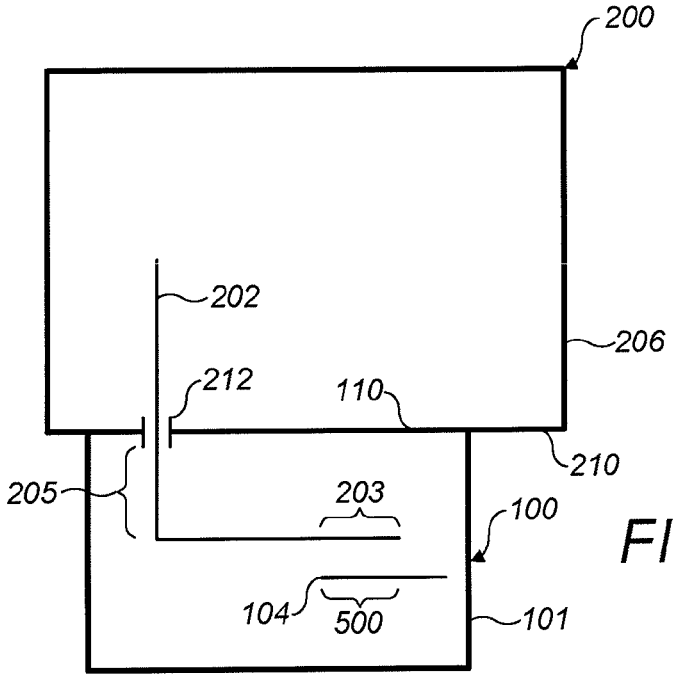
FIG. 6B is a schematic diagram showing coupling between a feed layer of an antenna and an electronic device track of an electronic device inside the electronic device enclosure after folding the feed layer.

Accordingly, in one arrangement, the electronic device track 104 is coupled to the feed layer 202 of the antenna by means of overlay coupling as shown in FIGS. 6A and 6B. An overlay coupler is an example of a broadside coupler and it couples two tracks sections of approximately a quarter wavelength in length that run one above the other capacitively. The wavelength referred to here is that corresponding to approximately the centre frequency of the operating band of the antenna in the dielectric material separating the feed layer 202 from the electronic device track 104.

The configuration of the U-shaped enclosure 208 and the feed layer 202 is such that the portion 201 of the feed layer 202 extending outside of the antenna housing 206 is at 90 degrees to the surface 210 connected to the electronic device 100. Furthermore, as shown in FIGS. 1 and 3, in this embodiment, the electronic device track 104 is parallel to the surface 110 of the electronic device enclosure 101 which is connected to the surface 201 of the antenna. Therefore the portion 201 of the feed layer 202 extending outside of the antenna housing 206 is at an angle of 90 degrees relative to the electronic device track 104. In order to achieve an overlay coupling arrangement in the manner described above, the portion 201 of the feed layer 202 is positioned parallel to the device track 104.

In this embodiment, a spacer 300, possibly in the form of a block of non-electrically conductive material as shown in FIG. 3, is secured to the outer surface 210 of the antenna housing 206 which is in turn connected to the electronic device 100. The height of the spacer 300 is preferably determined by the expected component height on the electronic device substrate. The portion 201 of the feed layer 200 is folded around a spacer 300 to bring it parallel to the electronic device track 104. Alternatively, the electronic device 100 can be connected to the antenna surface 210 as shown in FIG. 6A, so that the electronic device track 104 is parallel to the portion 201 of the feed layer 202 without folding the portion 201.

Once the portion 201 is secured, parallel, to the electronic device track 104, the combined arrangement forms an overlay coupler. The benefit of an overlay coupler is that it allows connection of two tracks without metal-to-metal contact, thus minimizing passive inter-modulation distortion reducing losses, increasing reliability and reducing cost. In order to achieve effective coupling, the feed layer section 211 and the electronic device track section 111 of the overlay coupling are both substantially a quarter wave length in the dielectric constant of the substrate in between them. The overlay coupling is preferably aligned with the longitudinal axis of the feed layer, and consequently, the portion 201 outside of the antenna housing 206 is bent around an axis perpendicular to both the longitudinal and the transverse axis of the feed layer by 90 degrees as shown in FIG. 2. A resulting end portion 209 of the feed layer 202 is substantially aligned with the antenna and at least part 211 of the end portion 209 is coupled to a section 306 of the electronic device track 104.

The overlay coupling can be achieved using known one piece overlay coupling e.g. known broadside coupling, wherein the feed layer 202 and the electronic device track 104 are printed on opposite sides of a dielectric substrate so that a section of the feed layer 202 is at least partially aligned with a section of the electronic device track 104. However, use of such a one piece overlay coupling arrangement means that the feed layer 202 of the antenna and the electronic device track 104 are permanently connected, which can be impractical and undesirable for maintenance and assembling.

In a preferred arrangement a two piece overlay coupling arrangement is used. In a general sense, a suitable overlay coupling 500 comprises two dielectric substrates, the feed layer 202 being printed on a surface of one dielectric substrate, and the electronic device track 104 being printed on a surface of the other dielectric substrate 103; the two substrates are positioned such that a section of the feed layer 202 is in registration with a section of the electronic device track 104. A dielectric substrate is located between a section 203 of the portion 201 of the feed layer 202 and a section 111 of the electronic device track. Preferably at least one of the two dielectric substrates, i.e. either or both the two dielectric substrates is located between the two sections of tracks. It is appreciated that this coupling arrangement of an electrically conductive track carried by the feed layer and an electrically conductive track of the electronic device provides a novel antenna arrangement comprising an antenna and an electronic device.

Figure 7:
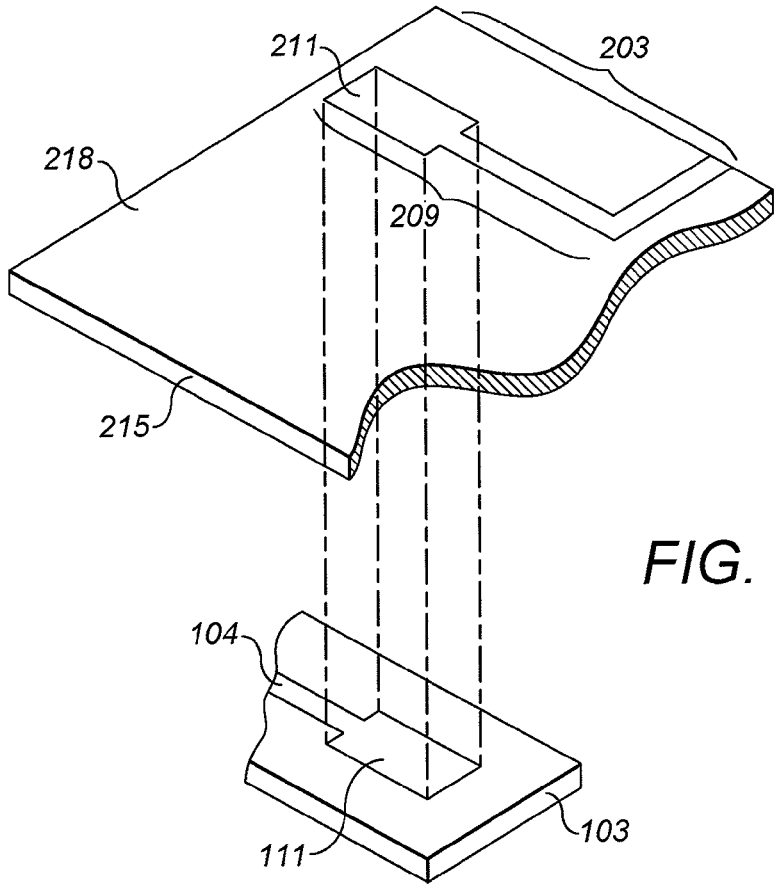
FIG. 7 is a schematic diagram showing two piece overlay coupling between a feed layer of a single polarized antenna and an electronic device track of an electronic device inside the electronic device enclosure.

In a preferred arrangement of the overlay coupling, and as shown in FIG. 3, the feed layer 202 is printed on the inner surface 218 of the feed layer substrate 215 closest to the U-shaped enclosure 208; the portion of the feed layer substrate 215 carrying the feed layer outside the antenna housing 206 is then folded around a spacer 300 and is located between a section 203 of the feed layer and the electronic device track 104 as also shown in FIG. 7. Alternatively, a third dielectric substrate (not shown) can be provided in between a section 203 of the portion 201 of the feed layer 202 and a section 111 of the electronic device track 104. Examples of a suitable dielectric substrate layer include air, a film layer and a solid dielectric substrate layer. In this arrangement, the section 203 of the feed layer 202 is at the end of the portion 201 and the section 111 of the electronic device track 104 is at one end of the track 104; however this is not necessary. For example, the sections can be in the middle of or at the other end of the two tracks respectively.

Figure 5:
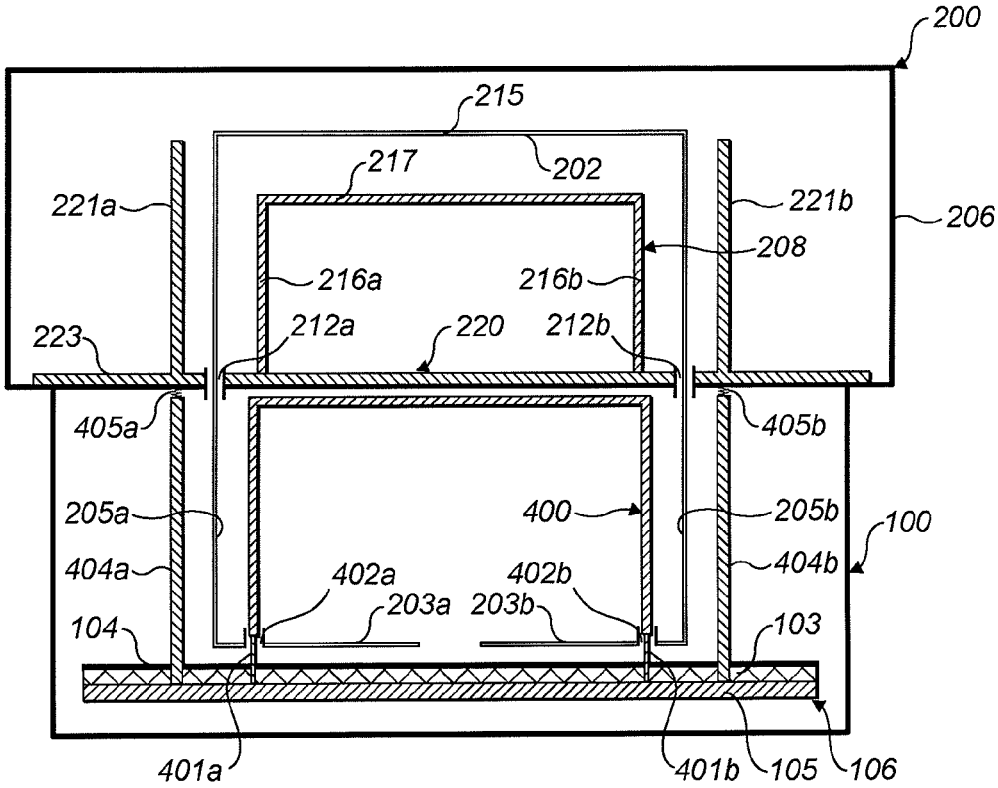
FIG. 5 is a schematic diagram showing details regarding the ground planes of a dual polarized embodiment of an antenna arrangement of FIG. 3.

A ground plane is required for the overlay coupling 500. In this embodiment, the ground plane 105 for the electronic device track 104 acts as the ground plane for the overlay coupling forming a microstrip transmission line structure for the coupling 500 as shown in FIG. 5. As a result, part of the feed layer 202 is in a triplate structure, e.g. the region within the antenna housing 206 (as described above), and part of the feed layer 202, e.g. the coupling region 500 and the parallel section 203 which is not coupled to the electronic device track 104, comprises a microstrip. The feed layer 202 is preferably designed so that the impedance remains substantially constant along the entire length of the feed layer 202 (i.e. throughout the tri-plate region and the micro-strip region); this may be achieved by varying the width of the tracks in the respective portions.

The ground planes 216, 221 of the feed layer 202 inside the antenna housing 206 need to be electrically coupled to the ground plane 105 of the electronic device track 104 to allow a continuous transmission line. Electronic coupling may be achieved by direct physical connection or through an intermediary e.g. via electrical wires. Direct physical coupling could be selected, for example, if the whole of the portion 201 of the feed layer 202 outside the antenna housing 206 is coupled to the electronic device track 104, in which case the ground plane for the electronic device track 104 can act as the ground plane 105 for the entire portion 201 of feed layer 202.

However, when only a section 203 of the portion 201 of the feed layer is coupled to the electronic device track 104 as shown in FIGS. 6A and 6B, at least one ground plane 404 needs to be provided for at least the part 205 of the portion 201 of feed layer 202 which is not coupled to the electronic device track 104 as shown in FIG. 6A or which is not parallel to the electronic device track 104 as shown in FIG. 6B. Furthermore, as shown in FIG. 3, the ground plane 404 is arranged so that it is electrically coupled to both the ground planes 216, 221 of the antenna 200 and the ground plane 105 of the electronic device 100. That is to say, the ground planes 216, 221 of the feed layer 202 are electrically coupled to the ground plane of the electronic device track 104 through the ground plane 404 for the part 203 of the feed layer 202.

In this embodiment, two ground planes, for example two blades of material, are provided for the part 203 of the feed layer 202, one on each side of the part 203 of the portion 201 of the feed layer 202. The part may be located between the two ground planes 400, 404 by means of mechanical spacers (not shown). Alternatively, two layers of dielectric material such as foam 450, 452, similar to the arrangement for the triplate region of the feed layer inside the antenna housing 206 as discussed above. Alternatively one of the two ground planes can be provided by a side surface of a U-shaped metal layer comprising two side surfaces and a middle surface. The U-shaped metal layer is preferably wrapped around the spacer 300, with the middle surface connected to the antenna housing 206.

Preferably the cover 220, also acting as a carrier for the enclosure 208 as well as the second ground plane for the feed layer 202 inside the antenna housing, is V-shaped or T-shaped (shown as T-shaped in FIG. 3) such that one section 221 of the cover 220 forms the second ground plane and a perpendicular section 223 forms part of the surface 210 of the antenna housing 206 which is connected to the electronic device 100. The non-electrically conductive material covering the antenna housing 206 preferably discontinues for at least some of the part of the perpendicular section 223 which is covered by the surface 110 of the electronic device 100 which is connected to the antenna 200. As a result the ground plane(s) inside the electronic device can be electrically coupled to the second ground plane of the feed layer 202 within the antenna housing easily, e.g. by mounting the ground plane(s) inside the electronic device onto, or otherwise attaching to, this section 223.

The conductive antenna elements 248 transceiving electromagnetic waves need to be protected by a non-electrically conductive material, which allows a relatively unattenuated electromagnetic signal transmission between the antenna inside the antenna housing 206 and outside equipment. Accordingly, in this embodiment, the conductive antenna elements are placed on top of the middle surface of the U-shaped enclosure 208, surrounded by the non-electrically conductive material, and located away from the surface 201, which is not covered by the non-electrically conductive material.

The conductive antenna elements excited by the feed layer can for example be of a cavity-backed, slot-radiating type as discussed in the prior art. In another arrangement, the conductive antenna elements of the feed layer comprise an array of patch antenna elements 248, as shown in FIG. 2. The patch antenna elements 248 are then fed by a common feed network, a portion of which extends outside of the antenna housing 206 as discussed above.

Unlike the prior art, slots are not provided in the enclosure 208. The enclosure 208 can therefore be made of a continuous sheet of material which can be formed using an extrusion process or a folding process from a continuous sheet of material, which is relatively cheap and easy compared to the moulding process used in the prior art. A flat sheet of material can be made then folded to form an enclosure 208 as described above. Alternatively a folded enclosure 208 can be formed using an extrusion process directly. Opening portions can be made on the side surfaces of the enclosure 208 if desirable.

The middle and two side surfaces of the U-shaped enclosure 208 may form a cavity; unlike conventional arrangements, the bandwidth is not constrained by the volume occupied by the cavity because the resonant structure, that is excited by or excites the feed layer, is provided by the gap between the ground plane, i.e. the middle surface of the electrically conductive enclosure 208, and the feed layer, instead of a cavity. In fact, using patch antenna elements 248 can eliminate the need for a cavity completely, or enables the cavity to be filled, for example by an electronic device such as a beam former.

In another arrangement, the electronic device track 104 may be carried by a PCB 106, said PCB being located within the antenna housing 206, possibly within the cavity of the enclosure 208. A section 111 of the electronic device track 104 can then be coupled to a section 203 of the feed layer 202 inside the antenna housing 206 as described above. In this arrangement, the electronic device 100 of the antenna arrangement can have an enclosure 101 as described above. Alternatively, the electronic device 100 might not have an enclosure 101.

In this embodiment, a second ground plane is not provided along the middle surface of the enclosure 208 above the middle portion 232 of the feed layer 202, this comprising the patch antenna elements 248. Instead, a non-electrically conductive cover 250 such as a polycarbonate sheet is provided on top of the middle portion 232 of the feed layer 202 to reduce the resonant frequency for the patch antenna elements as shown in FIG. 3. The non electrically conductive cover 250 and the middle surface of the enclosure 208, with the feed layer 202 held there in between, is secured together by securing means, e.g. via screws and nuts or other suitable fixing means. In one arrangement, the non-electrically conductive cover 250 forms part of the antenna housing 206. It will be appreciated that this arrangement of patch antenna elements 248 in conjunction with the electrically conductive enclosure 208 and the non-electrically conductive cover 250 provides a novel antenna.

A foam layer 226, or air with mechanical spacers, is provided between the middle surface of the enclosure 208 and the middle portion 232 of the feed layer 202. Generally the greater the distance between the middle surface of the electrically conductive enclosure 208 and the conductive antenna elements of the feed layer is and the lower permittivity of any intervening dielectric material, the greater the bandwidth that can be achieved. It is desirable that the same radiation characteristics are obtained over the whole band of interest, so that the antenna pattern generated over the band of interest is substantially constant. The upper limit to the spacing may be considered to have been reached when different resonant modes are excited at different parts of the band, unwanted levels of surface wave radiation is generated or when the impendence characteristic varies excessively. A different dielectric substrate and more than one dielectric substrate layer may be used instead. However, an increase in broadband performance is achieved by the combination of a relatively large ground plane spacing between the middle surface of the electrically conductive enclosure 208 and the conductive antenna elements of the feed layer, an essentially air dielectric (i.e. with low permittivity) beneath the conductive antenna elements 248, and using patch antenna elements as conductive antenna elements.

As mentioned above, embodiments of the invention can also be used for a multi-element array antenna, e.g. a multi-beam antenna, addressing the problem of the interface between the individual sub-arrays and an electronic device such as an azimuth beam former in particular, because overlay coupling is used instead of connectors, metal to metal contact and cost are reduced. Furthermore, it is easier to assemble the electronic device with the antenna this way since cable connections are not used. This is particularly significant for multi-element array antennas where more than one feed layers are connected to electronic device track(s). The embodiments shown in FIGS. 8A, 8B, 8C and 8D, for example, comprise a multi-element array antenna comprising a plurality of sub-arrays. Each sub-array comprises an enclosure 208 and a feed layer 202, a portion 201 of which extends outside of the antenna housing 206 through an opening 212 in the surface 210 of antenna housing 206. Each sub-array may be provided within a different antenna housing 206 or more than one sub-array may be contained in a single antenna housing 206. As shown in all these embodiments, the longitudinal axis of the feed layer 202, the longitudinal axis of the feed layer substrate, and the longitudinal axis of the enclosure 208 are preferably perpendicular to the direction of the multi-element array antenna formation.

A second ground plane 221 may not be provided for the feed network regions of the feed layer 202 along the side surfaces 216*a*, 216*b* of the enclosure 208 inside the antenna housing 206, thereby forming a microstrip transmission region. However, for multi-element array antennas, a second ground plane 220 is desirable because, together with the enclosure 208, it forms an enclosed triplate transmission line structure which results in a well controlled distribution circuit; in addition it isolates adjacent feed networks along adjacent side surfaces 216*a*, 216*b* of the enclosures 208*a*, 208*b* of adjacent sub-arrays so as to minimize interference between adjacent feed networks of different sub-arrays.

Figure 8A:
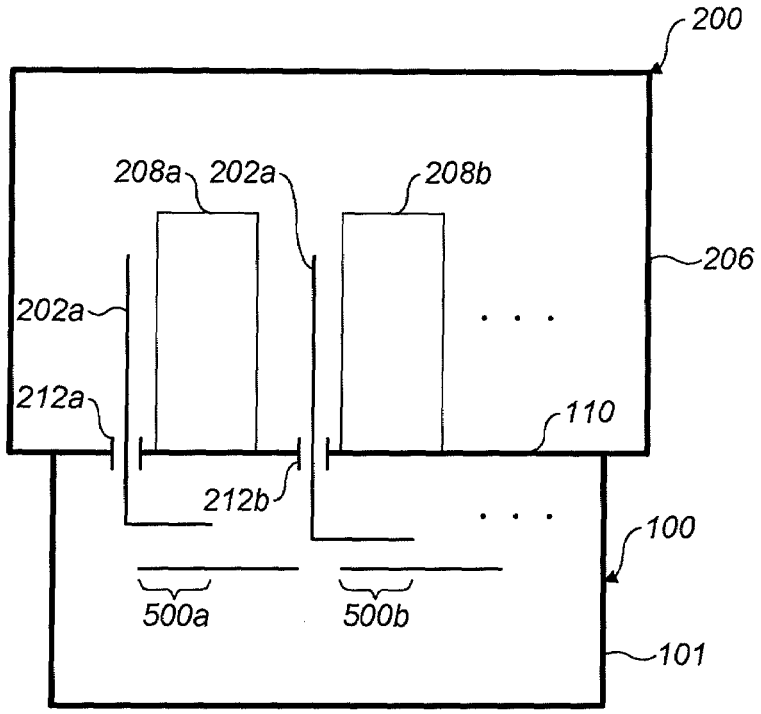
FIG. 8A is a schematic diagram showing an antenna arrangement comprising a multi-element array antenna and an electronic device comprising a plurality of electronic device tracks according to an embodiment of the invention.
Figure 8B:
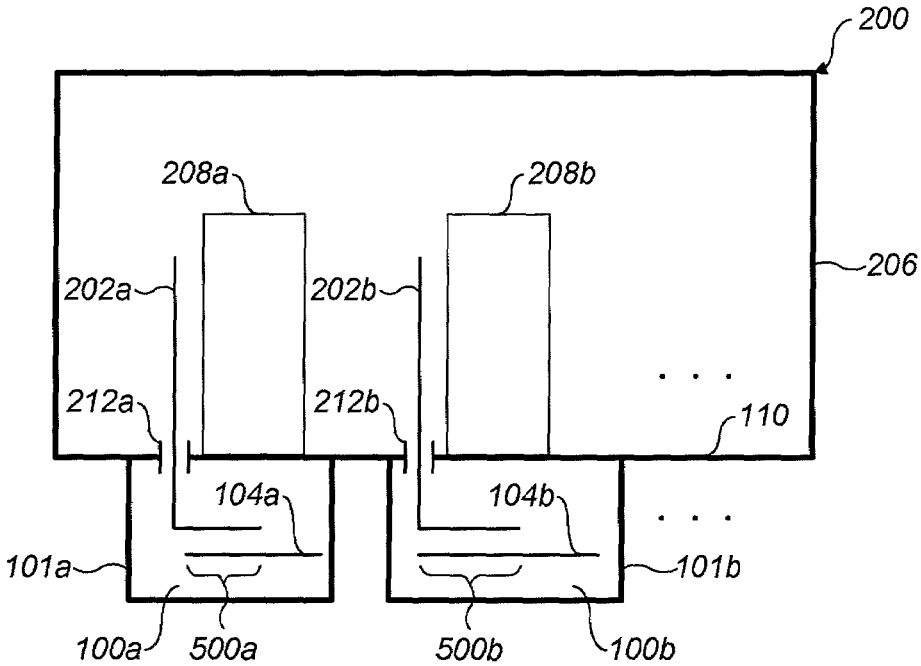
FIG. 8B is a schematic diagram showing an antenna arrangement comprising a multi-element array antenna and a plurality of electronic devices each comprising an electronic device track according to an embodiment of the invention.
Figure 8C:
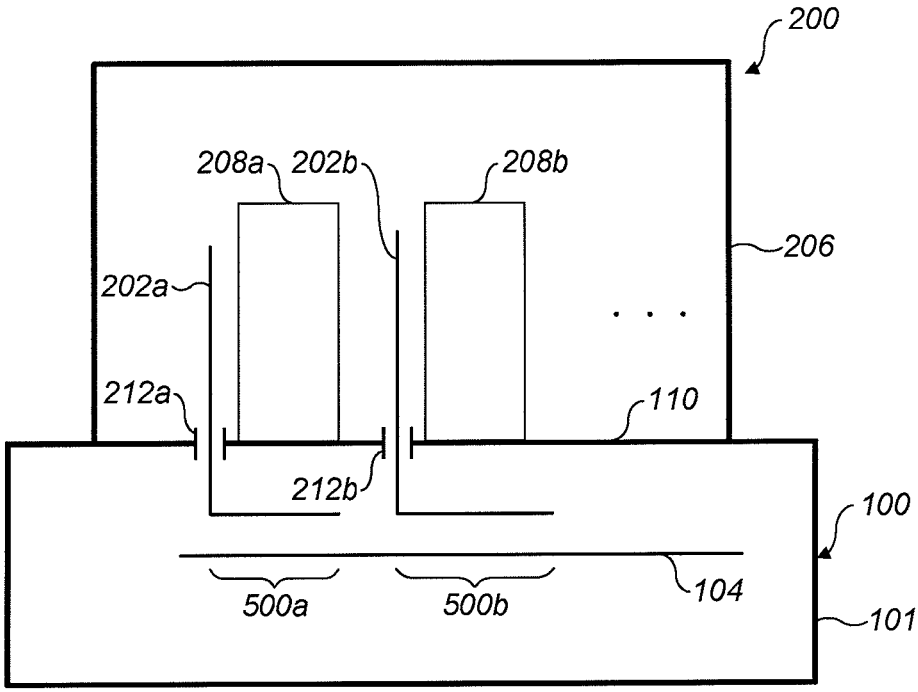
FIG. 8C is a schematic diagram showing an antenna arrangement comprising a multi-element array antenna and an electronic device comprising an electronic device track according to an embodiment of the invention.

As mentioned above, it is desirable to space antenna elements 248 no more than approximately a half wavelength apart in azimuth at a given cover frequency to avoid generating grating lobes in the antenna pattern with associated unwanted nulls. Therefore the outer middle surface 217 of the enclosure 208 can be of any arbitrary length depending on the size and number of the conductive antenna elements but preferably only less than or equal to half the cover frequency wavelength. Limiting the width in this fashion allows closely spaced sub-arrays to be built by positioning multiple electrically conductive enclosures 208 each carrying a feed layer 202 side by side. Furthermore, individual electrically conductive enclosures 208 of different sub-arrays are preferably inter-connected allowing the continuity of the inner ground plane. As regards the respective feed layers, each feed layer 202*a*, 202*b* can be coupled to a different, and possibly separate, electronic device track 104*a*, 104*b*, in which case all electronic device tracks 104*a*, 104*b* can be provided in a single electronic device 100 comprising one electronic device enclosure 101, as shown in FIG. 8A. Each electronic device track 104*a*, 104*b* can be provided in a different electronic device 100*a*, 100*b*, each comprising an electronic device enclosure 101*a*, 101*b*, as shown in FIG. 8B. Alternatively, two or more feed layers 202*a*, 202*b* can be coupled to a single electronic device track 104 in an electronic device 100 as shown in FIG. 8C. Electronic devices 100 such as amplifiers and transceivers are preferably implemented using these methods.

Figure 8D:
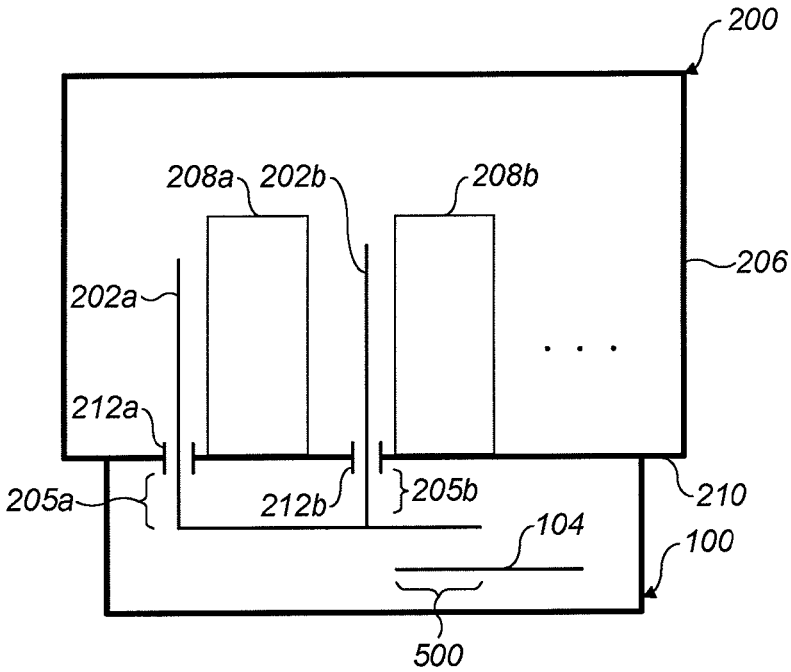
FIG. 8D is a schematic diagram showing an antenna arrangement comprising a multi-element array antenna and an electronic device comprising an electronic device track, wherein feed layers of the antenna are combined inside the electronic device enclosure before coupled with the electronic track, according to an embodiment of the invention.

The feed layers 202*a*, 202*b* can be coupled with one another outside of the antenna housing 206 before coupling to an electronic device track 104. The feed layers 202*a*, 202*b* can for example be coupled with one another by a conventional connector, one piece overlay coupling, or two piece overlay coupling described above. An electrically conductive track 207 resulting from, or connected to, the coupling can then be coupled to an electronic device track 104 in an electronic device 100 as shown in FIG. 8D. Electronic devices 100 such as beam formers are preferably connected this way.

The embodiments and corresponding figures relate to single-polarized antennas. However, it is to be understood that multi-polarized antennas are equally applicable for the purpose of this invention. FIG. 4 illustrates a dual polarized antenna embodiment of the invention, in which two feed lines, preferably orthogonal to one another, are connected to each of the conductive antenna elements, resulting in two common feed networks one on each side of the conductive antenna elements as shown in FIG. 2. The two feed networks cover the two side surfaces of the electrically conductive enclosure 208 respectively. As discussed above and as shown in FIG. 2, each feed network is then combined and a portion 201 of the resulting track extends outside of the antenna housing through an opening 212*a*, 212*b* in the surface 210 of the antenna housing 206. The two portions are then folded around two opposite sides of the same spacer 300 before ending up on the same surface of the spacer 300, the surface being opposite the surface of the spacer which is mounted onto the antenna housing. Both portions 201*a*, 201*b* are therefore parallel to the PCB carrying the electronic tracks so that each portion can be coupled to a section of the same or a different electronic device track respectively.

The V-shaped or T-shaped cover 220 also acting as a second ground plane as shown in FIG. 5 is provided for each polarization along a side surface of the enclosure 208. As mentioned above, the second ground plane 221*a*, 221*b* together with the enclosure 208 forms an enclosed triplate transmission line structure which results in a well controlled distribution circuit and isolates adjacent feed networks along adjacent side surfaces 216*a*, 216*b* of the enclosures 208*a*, 208*b* of adjacent sub-arrays. The covers 220 for different polarizations may be connected or form one single cover 220. For a dual polarized antenna, such a single cover 220 may be of a U or TT shape.

In some of the above embodiments, the feed layers 202*a*, 202*b* are substantially U-shaped. This is desirable especially when multiple dual polarization sub-arrays are provided, because substantially U-shaped feed layers 202 facilitate a simple dual polarized sub-array construction and simplifies the alignment of a plurality of closely spaced sub-arrays.

The above embodiments show a single feed layer 202 per enclosure 208; however it will be appreciated that more than one feed layer may be provided and more than one feed layer may extend outside of the antenna housing. Furthermore, whilst the feed layer 202 is associated with one feed layer substrate, the skilled person will recognise that more than one feed layer substrate may be used, and that the feed layer substrate may be made of different materials in different regions.

In the above embodiments, a non-electrically conductive cover 250 is located on top of the conductive antenna elements of the feed layer 202 to provide frequency control of the radiating properties of the patch antenna elements 248 by making the patch 248 electrically larger than its physical size in the absence of the dielectric cover 250. Although the non-electrically conductive cover 250 is desirable, it is not necessary. For example, if the dielectric substrate 226 underneath the patch antenna elements 248 is other than foam/air (i.e. of higher permittivity), the substrate 226 will also have the effect of increasing the electrical size of the patches 248, possibly removing the need for an upper cover 250. Alternatively, since stand alone single sub-array antennas are not constrained to 0.5 wavelengths width, the patches 248 can be physically larger, avoiding the need for any additional dielectric substrates of higher permittivity than air above or below them.

As described above, and will be appreciated from a review of the figures exemplifying embodiments of the invention, the angle between the middle surface 217 of the electrically conductive enclosure 208 and either of the two side surfaces 216*a*, 126*b* of the electrically conductive enclosure 208 is preferably 90 degrees; however, other angular arrangements are possible. In particular, angles less than or close to 90 degrees are more desirable than angles substantially more than 90 degrees especially for multi-element array antennas.

Another aspect of this invention relates to a method of assembling the antenna arrangement comprising an antenna 200 and an electronic device 100 described above. For illustrative purposes the method is described with reference to FIGS. 4, 5, 10, 11, 13, 14 and 15, in relation to a dual polarized stand alone single sub-array antenna; however it is appreciated that the method can be used to assemble all possible antenna arrangements described above.

An antenna structure is assembled and an electronic device built before the antenna and the electronic device are connected. Before an antenna structure can be assembled, various components need to be manufactured or otherwise provided. The electrically conductive enclosure 208 comprising a continuous sheet of material is manufactured using e.g. an extrusion or folding process. The enclosure 208 is preferably U-shaped comprising a middle surface 217 and two side surfaces 216*a*, 126*b* as shown in FIG. 4. The enclosure 208 provides physical support for the feed layer 202 inside the antenna housing 206 and also functions as a first ground plane for the feed layer 202 inside the antenna housing 206, as described above.

A dielectric substrate such as a film layer 215 is manufactured or otherwise provided. A feed layer 202 is printed on the film layer 215 with the middle portion 232 of the feed layer 202 on a middle portion 234 of the film layer 215 and the two side portions 230*a*, 230*b* of the feed layer 202 on two side portions 236*a*, 236*b* of the film layer 215.

A TT-shaped cover 220 is manufactured or otherwise provided; the cover 220 comprises two sections 221*a*, 221*b*, preferably substantially parallel to one another, functioning as a second ground plane for the two side portions 230*a*, 230*b* of the feed layer 202 inside the antenna housing 206 and one perpendicular section 223 which carries the enclosure 208. The perpendicular section 223 comprises two openings 212*a*, 212*b* through which the two portions of film layer extend outside of the antenna housing 206 at step 28.

An antenna housing 206 is manufactured using a non-electrically conductive material, which allows a relatively unattenuated electromagnetic signal transmission between the antenna inside the antenna housing 206 and outside equipment. Referring back to FIG. 1, the antenna housing 206 could be of any shape; however in this embodiment, it comprises a hollow tube with a substantially flat surface 210 and two end caps. The substantially flat surface 210 comprises a hole which is to be covered by the surface 110 of the electronic device 100 after the surface 110 is connected to the surface 210 of the antenna 200.

Figure 9:
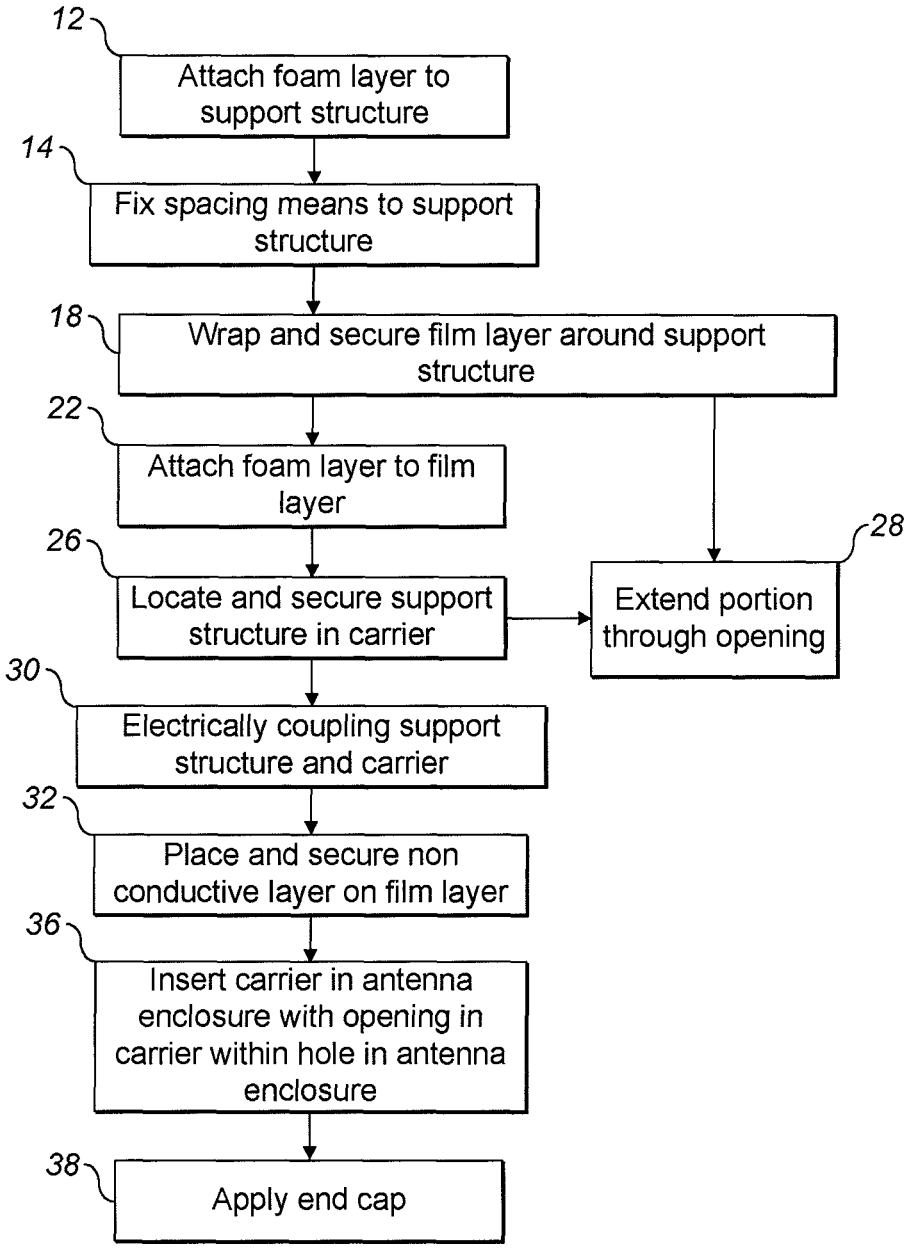
FIG. 9 is a flow diagram showing steps involved in assembling a novel dual polarized antenna structure according to an embodiment of the invention.

FIG. 9 is a flow diagram showing a method of assembling a dual polarized antenna structure. At step 12 a relatively thin foam layer 224*a*, 224*b* is attached to the two outer side surfaces 216*a*, 216*b* of the enclosure 208 respectively and a relatively thick foam layer 226 attached to the outer middle surface of the enclosure 208 as shown in FIG. 4. In one arrangement, the relatively thin foam layers are 1 to 2 mm thick, while the relatively thick foam layer is 10 to 15 mm thick. Some or all of the foam layers 224*a*, 224*b*, 226 may be self adhesive to aid the attachment.

At step 14, and referring to FIG. 3, one or more spacing means (not shown), preferably of a similar height to that of the relatively thick foam layer 226, are fixed to the outer middle surface 217 of the enclosure 208 possibly from underneath the middle surface 217 of the enclosure 208. The spacing means may run through the relatively thick foam layer 226.

The film layer 215 is then wrapped around the outer surface of the enclosure 208 at step 18, with the feed layer 202 on the inner surface of the film layer 215 and adjacent to the foam layers 224*a*, 224*b*, 226 attached to the enclosure 208. The film layer 215 preferably covers the outer surface of the enclosure 208, with the middle portion 232 of the feed layer 202 on top of the middle surface of the enclosure 208 and the side portions of the feed layer 202 overlying the side surfaces of the enclosure 208. However, a portion 238*a*, 238*b* of the film layer 215 carrying a portion 201*a*, 201*b* of the feed layer 202 extends beyond each of the two side surfaces of the enclosure 208 respectively in accordance with step 20 and later through the openings 212*a*, 212*b* in the surface 210 of the antenna housing 206 into the electronic device enclosure 101 at step 28. The film layer 215 is secured to the foam layers 224*a*, 224*b*, 226 attached to the enclosure 208 using e.g. glue. Optionally, temporarily fastening means may be used to achieve better alignment between the film layer and the electrically conductive enclosure 208.

Then at step 22, a second, possibly self adhesive, foam layer 222*a*, 222*b* is attached to each of the two outer side portions of the film layer respectively.

As can be seen from FIG. 4 and better from FIG. 5 showing only the ground plane details, the enclosure 208 carrying the feed layer 202 and foam layers 222*a*, 222*b*, 224*a*, 224*b*, 226 is located within the TT-shaped cover 220, via the two parallel sections 221*a*, 221*b* of the TT-shaped cover 220 at step 26. The two portions 238*a*, 238*b* of the film layer 215 carrying the two portions 201*a*, 201*b* of the feed layer 202 then extend through the openings 212*a*, 212*b* in accordance with step 28. The enclosure 208 and the cover 220 are secured together as so to prevent relative movement with respect to one another using e.g. fastening means.

At step 30, the enclosure 208 is electrically coupled to the cover 220 to connect the two ground planes. In one arrangement, this is achieved through one or more protrusions (not shown) provided by, or attached to, the middle surface of the enclosure 208. The protrusions extend through corresponding holes in the film layer and rest on the parallel sections 221*a*, 221*b* of the cover 220 thereby electrically connecting the first ground plane, i.e. the cover 220, and the second ground plane, i.e. the enclosure 208, for the feed layer inside the antenna housing. The connection between the protrusions and the cover 220 may be secured using e.g. conductive fabric tapes.

A non-electrically conductive cover 250 such as a polycarbonate sheet is then placed on top of the middle portion 234 of the film layer 215 at step 32 as shown in FIG. 4. The non-electrically conductive cover 250 is secured to the spacing means using e.g. a corresponding number of fastening means such as nails, staples, bolts or screws.

The two portions 238*a*, 238*b* of the film layer 215 carrying the two portions 201*a*, 201*b* of the feed layer 202 extending beyond the side surfaces 216*a*, 216*b* of the enclosure 208 may be temporarily taped onto the cover 220, before the cover 220 carrying the enclosure 208 is inserted into the antenna housing 206 at step 34. After insertion, the two openings 212*a*, 212*b* in the perpendicular section 223 of the cover 220, through which the portions 238*a*, 238*b* of the film layer 215 extend outside of the antenna housing 206, are arranged so that they are within the antenna housing 206. The tape is removed to release the two portions 238*a*, 238*b* of film layer 215, enabling them to extend through the hole in the surface 210 of the antenna housing 206. Part of the perpendicular section 223 of the cover 220, once inserted into the antenna housing, forms part of the surface 210 of the antenna housing 206 where the hole in the surface 210 of the antenna housing 206 is provided.

Two end caps are applied to the two opposite ends of the hollow tube to help secure the cover 220 and the enclosure 208 in position at step 38.

Figure 11:
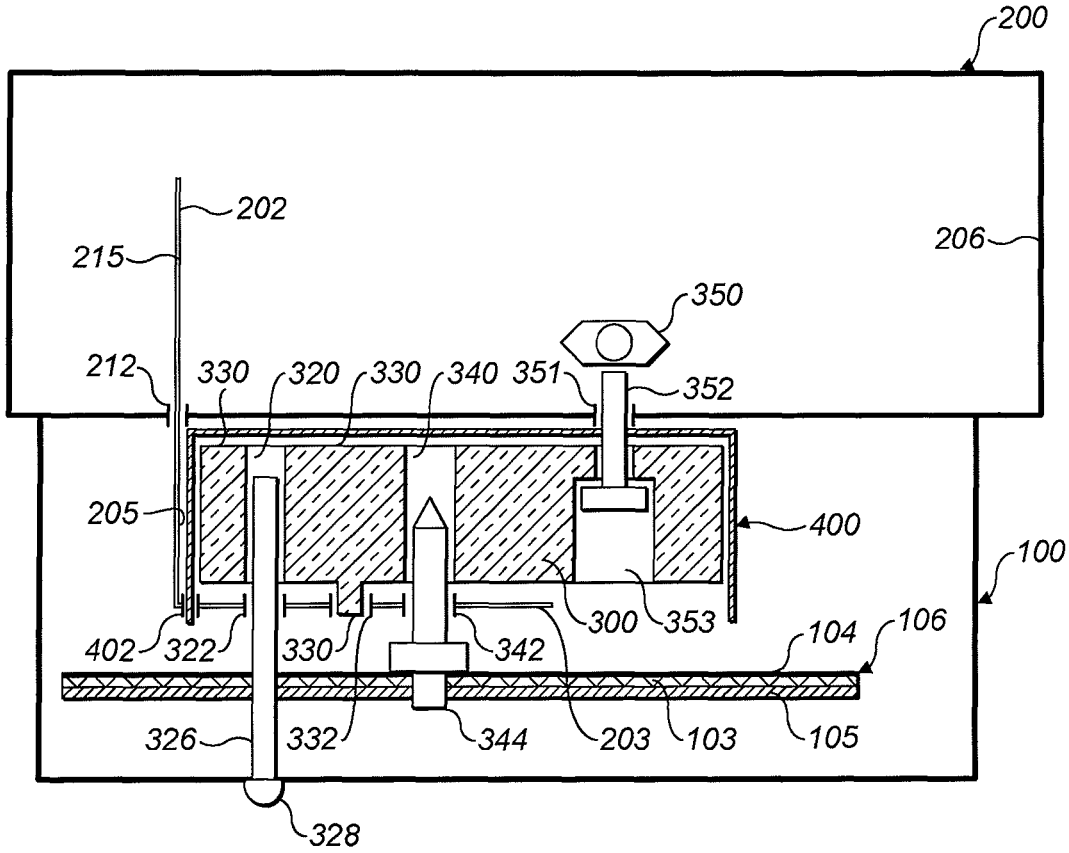
FIG. 11 is a schematic diagram showing detailed components for assembling an antenna arrangement according to an embodiment of the invention.
Figure 14:
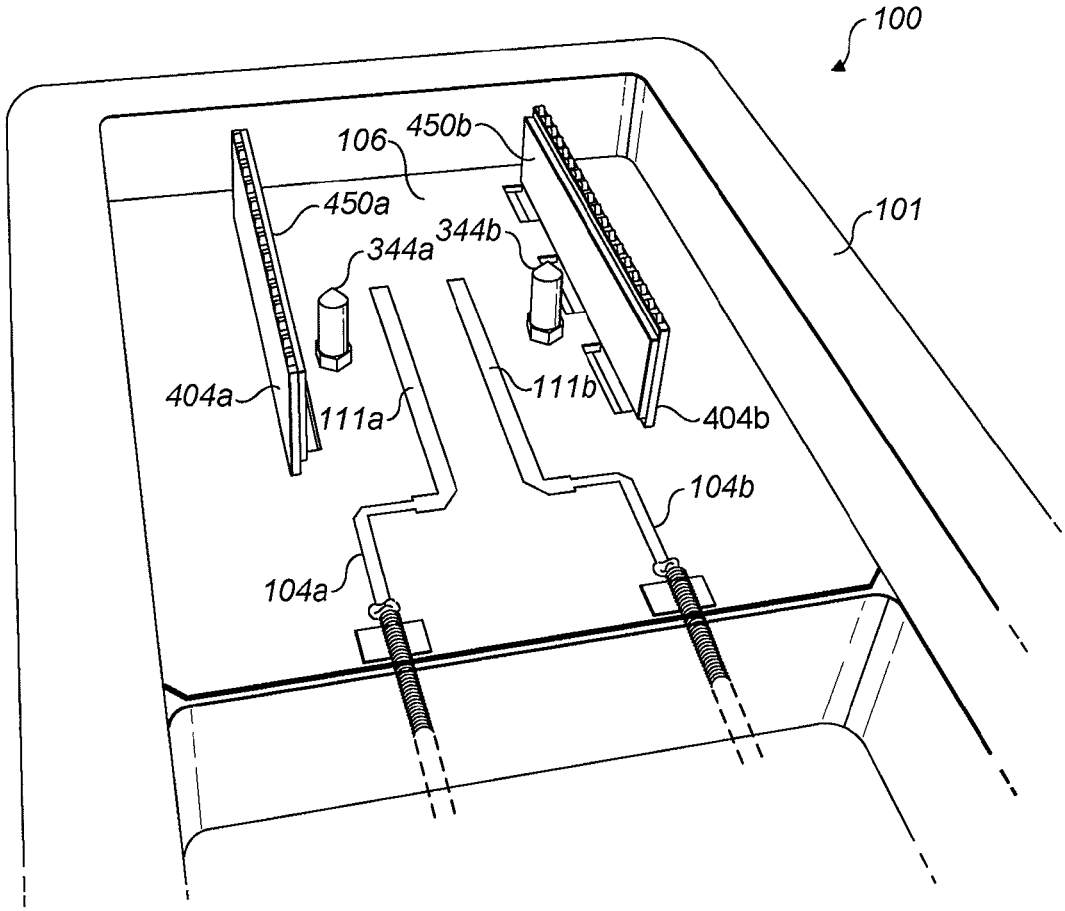
FIG. 14 is a schematic diagram showing a printed circuit board arrangement inside an electronic device according to an embodiment of the invention.

Turning now to aspects associated with assembly of the electronic device 100, the device enclosure 101 is typically a cast or moulded structure within which a PCB 106 carrying two parallel electrically conductive tracks 104*a*, 104*b* are fixed. Referring to FIGS. 11 and 14, one or more guidance pins 344 are attached to the PCB 106 so that relative lateral movement with respect to one another is restricted, using for example clinch studs. In a preferred embodiment, the guidance pins 344 can be mounted onto the ground plane 105 of the PCB 106. The guidance pins 344 preferably comprise non-electrically conductive material. As can be seen in FIGS. 4 and 14, two parallel blades of metal 404*a*, 404*b*, each of which is preferably of a substantially similar size to that of a side surface of the U-shaped metal 400, are mounted onto the ground plane 105 of the PCB 106, preferably perpendicular to the PCB 106, so as to be able to receive the spacer 300 with the U-shaped metal layer 400 surrounding the spacer 300, the portions 238*a*, 238*b* of the film layer 215 wrapped around the metal layer 400 and the spacer 300 and the foam layers attached thereto.

Figure 10:
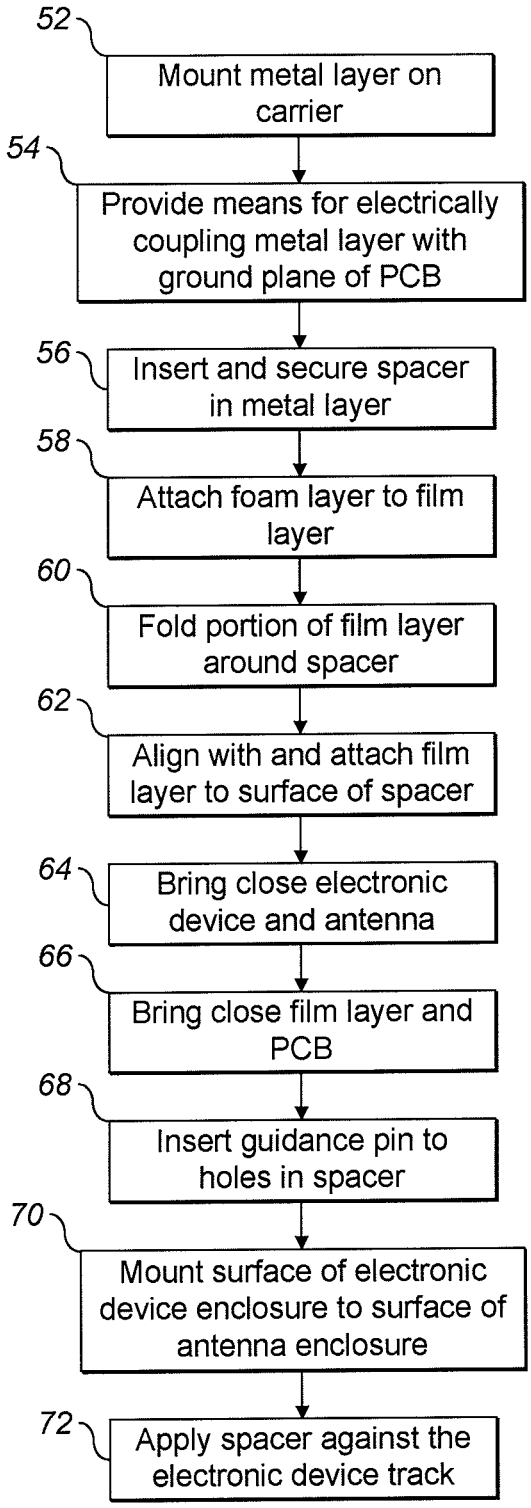
FIG. 10 is a flow diagram showing steps involved in physically connecting an electronic device onto an exterior surface of an antenna according to an embodiment of the invention.

The assembly of the electronic device 100 with the antenna housing will now be described with reference to FIG. 10: at step 52, the middle surface of the metal layer 400 is mounted onto the outer surface of the perpendicular section of the cover 220 in between the two openings 212*a*, 212*b* using for example conductive adhesive. The physical connection of this ground plane 400 with the cover 220 ensures a continuous ground plane for the feed layer 202 inside and outside the antenna housing 206.

Figure 12:
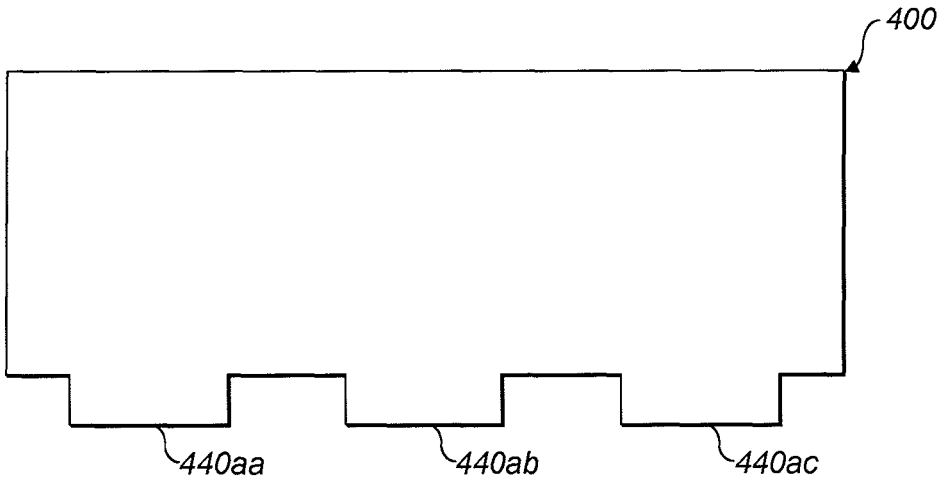
FIG. 12 is a schematic diagram showing structural details of a side surface of an electrically conductive layer used in assembling an antenna arrangement according to an embodiment of the invention.

At step 54, the ground plane 105 is electrically coupled with the metal layer 400. Referring also to FIG. 12, the ground plane 400 is in contact with the ground plane 105 of the PCB 106 through contacting means such as one or more protrusions 440*aa*, 440*ab*, 440*ac* provided at or attached to the end of each of the two side surfaces of the U-shaped metal layer 400. The protrusions 440*aa*, 440*ab*, 440*ac* extend through corresponding holes in the feed layer 202, through the dielectric substrate 103 of PCB, and contact the ground plane 105 of the PCB 106, once the electronic device 100 is connected to the antenna 200. Once mounted to the cover 220 and electrically coupled to the ground plane 105 of the PCB 106, the metal layer 400 effectively electrically couples the ground planes 216, 221 for the feed layer 202 inside the antenna housing 206 with the ground plane 105 of the PCB 106 so as to ensure a continuous electrical connection between the antenna 200 and the electronic device 100.

At step 56, a spacer 300 preferably comprising a block of non-electrically conductive material is inserted into the U-shaped metal layer 400, as shown in FIG. 11. The spacer 300 is preferably of a corresponding size to fit within the cavity provided by the U-shaped metal layer 400. The spacer 300 is secured to the metal layer 400 and to the outer surface 210 of the antenna housing 206 relatively loosely by e.g. inserting fastening means 352 through a hole 353 in the spacer 300, a corresponding hole in the middle surface of the U-shaped metal layer 400, a corresponding hole 351 in the surface 210 of the antenna housing, and locating means 350 inside the antenna housing 206. The fastening means preferably comprise non-electrically conductive material. An example of the fastening means is one or more screws 353 (only one is shown). More than one fastening means may be provided.

The surface of the spacer 300 opposite the middle surface of the metal layer 400 (hereinafter "the uncovered surface") is substantially uncovered by the metal layer 400 to allow for microstrip coupling between the sections 203*a*, 203*b* of the feed layer parallel to the electronic device tracks 104*a*, 104*b* and the corresponding sections 111*a*, 111*b* of the electronic device tracks 104*a*, 104*b* as shown in FIG. 15. The ground plane 105 of the PCB 106 also serves as the ground plane for the parallel section 203 of the feed layer 202.

Then, at step 58, foam layers 452*a*, 452*b* are attached for at least part of the film layer outside the antenna housing 206. Referring back to FIG. 4, a foam layer 452*a*, 452*b* is located in between each of the two outer side surfaces of the U-shaped metal layer 400 and the portion of the film layer 215 next to that side surface of the metal layer 400 respectively. In each case the foam layers 452*a*, 452*b* are attached to either the outer side surface of the U-shaped metal layer 400 or the corresponding portion of the film layer or both. A second foam layer 450*a*, 450*b* is attached to the other side of each of the two portions of the film layer respectively. The foam layers may be self-adhesive to aid the attachment.

As shown in FIGS. 2 and 4, the two portions 238*a*, 238*b* of the film layer 215 are folded around the spacer 300 along two opposite side surfaces of the U-shaped metal layer 400 surrounding the spacer 300 at step 60, so that a section of portion 238*a*, 238*b* of the film layer 215 carrying a section 203*a*, 203*b* of the portion 201*a*, 201*b* of the feed layer 202 is substantially parallel to at least a section 111*a*, 111*b* of the electronic device track 104*a*, 104*b* respectively, which, in this embodiment, is parallel to the surface 110 of the electronic device enclosure 101 which is connected to the surface 201 of the antenna housing 206 as shown in FIG. 14.

Figure 13:
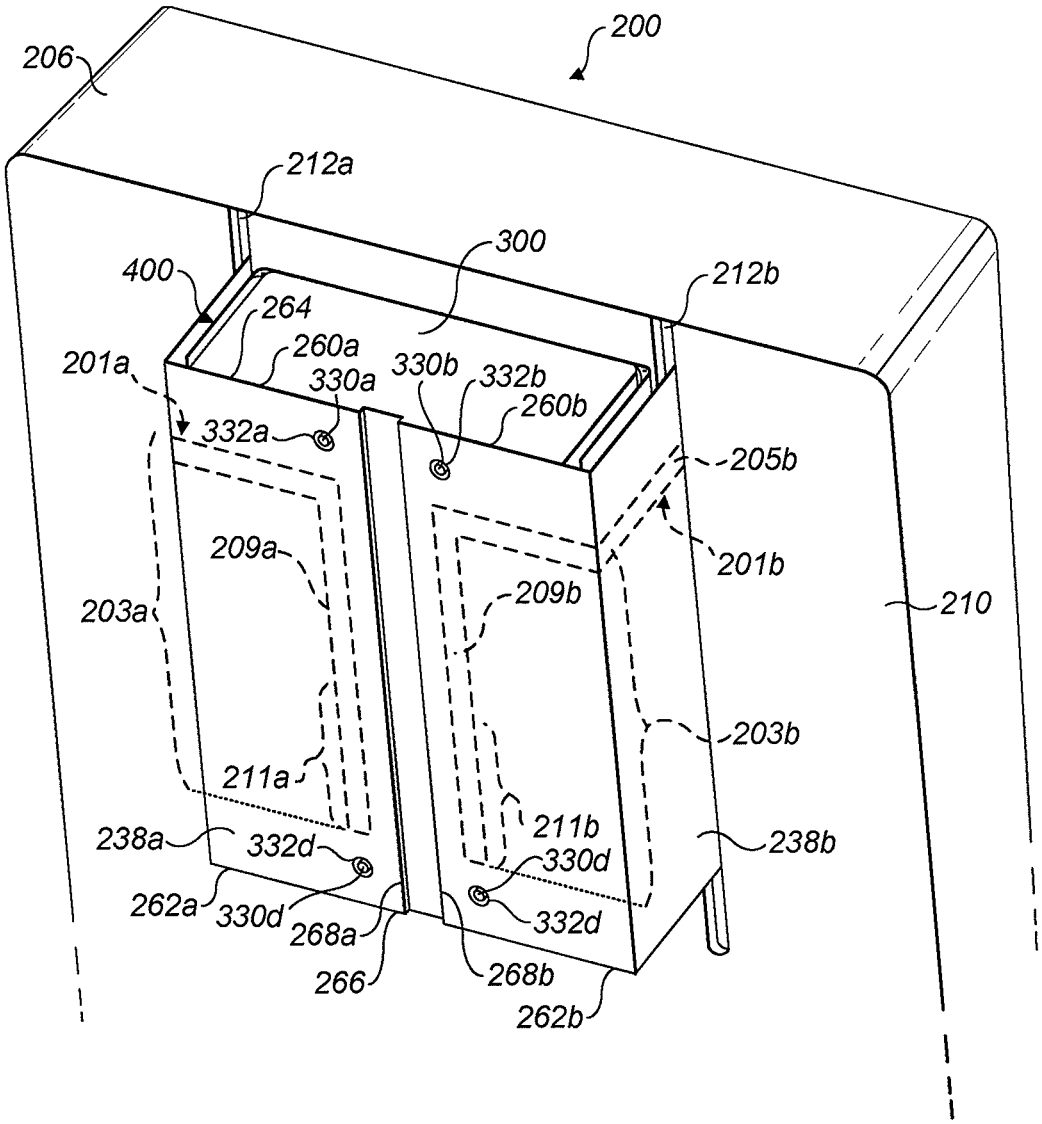
FIG. 13 is a schematic diagram showing alignment between a section of the film layer and an uncovered surface of the spacer outside the antenna housing according to an embodiment of the invention.

Referring also to FIG. 13, at step 62, the side edges 260*a*, 262*a*, 260*b*, 262*b* of the two sections of the film layer carrying two sections 203*a*, 203*b* of the feed layer 202 respectively are aligned with the top 264 and bottom 266 edges of the spacer 300 and the end edges 268*a*, 268*b* with a central recess 270 provided in the uncovered surface of the spacer 300. The two sections of the film layer 215 are attached to spacer 300 so as to achieve registration of the sections of the film layer with the spacer 300. This may be achieved by securing registration means 330 of the spacer 300 with receiving means 332 of the feed layer 202 as shown in FIGS. 11 and 12. The registration means can be one or more buttons attached to or provided by the uncovered surface of the spacer 300 and the receiving means can a corresponding number of holes in the film layer. Alternatively, the sections of the film layer may be glued onto the spacer 300. The uncovered surface of the spacer 300 may be self-adhesive to aid the attachment.

The electronic device 100 and the antenna 200 are brought close together at step 74. In particular, a surface 110 of the electronic device enclosure 101, which is substantially uncovered by the electronic device enclosure 101, is brought close to the perpendicular section 223 of the cover 220 through the hole in the surface 210 of the antenna housing 206 while the spacer 300 together with the U-shaped metal layer 400 surrounding the spacer 300, the portions 238*a*, 238*b* of the film layer 215 wrapped around the metal layer 400 and the spacer 300 and the foam layers attached thereto is received by the two blades of metal 404*a*, 404*b* attached to the PCB 106.

Bringing the electronic device 200 close to the antenna 100 as described above also brings the PCB 106, as shown in FIG. 14, close to the sections of film layer carrying the sections 203*a*, 203*b* of the feed layer 202 on the uncovered surface of the spacer 300, as shown in FIG. 13, in accordance with step 76.

As shown in FIGS. 11 and 12, the guidance pins 344 attached to the PCB 106 are inserted through a corresponding number of holes 340 in the spacer 300 at step 78, as the electronic device 100 and the antenna 200 are brought close together, thereby to secure the spacer 300 to the PCB 106 so that relative lateral movement with respect to each other is prevented. This effectively secures the sections 203*a*, 203*b* of the feed layer 202 to the electronic device tracks 104*a*, 104*b* respectively, because the sections of film layer 215 carrying the sections 203*a*, 203*b* of the feed layer 202 on the uncovered surface of the spacer 300 are secured to the spacer 300 and the electronic device tracks 104*a*, 104*b* are printed on the PCB 106. The location of the guidance pins 344 ensures that the sections 203*a*, 203*b* of the feed layer 202 overlap with the corresponding sections 111*a*, 111*b* of the electronic device tracks 104*a*, 104*b* when the guidance pins 344 are inserted into the spacer 300. As a result the sections 203*a*, 203*b* of the feed layer 202 are at least partially aligned with the sections 111*a*, 111*b* of electronic device tracks 104*a*, 104*b* respectively as shown in FIG. 15.

Since the tolerance between antenna housing 206 and the electronic device enclosure 101 is relatively coarse, the spacer 300 is preferably secured relatively loosely to the outer surface 210 of the antenna housing 206 and the portions 201 of the feed layer 202 outside the antenna housing 206 are at least partly flexible so as to facilitate alignment of the tracks.

At step 80, the surface 101 of the electronic device enclosure 101 is mounted onto the outer surface 201 of the antenna housing 206 by e.g. applying connection means such as screws around the periphery of the overlapping surfaces. Conductive caulking compounds may also be applied around the edges of the overlapping surfaces for better shielding.

Finally, at step 82, the spacer 300 is located against the electronic device tracks 104*a*, 104*b* so as to control relative lateral movement between the sections 203*a*, 203*b* of the feed layer and the corresponding sections 111*a*, 111*b* of the electronic device tracks 104*a*, 104*b* respectively for overlay coupling 500. Securing the two sections so as to restrict relative lateral movement therebetween ensures that the electrical coupling between the two sections remains stable. Referring again to FIG. 11, in this embodiment, this is facilitated by fixing means 326, which are inserted from an exterior face of the electronic device 100, through a hole 328 in the electronic device enclosure 101, a corresponding hole in the PCB 106, a corresponding hole in the film layer 215, and a corresponding hole 320 in the spacer 300. The fixing means 326 preferably comprise non-electrically conductive material. An example of the fixing means 326 is one or more screws (only one is shown), and silicon sealant may also be applied around the hole(s) 328 in the electronic device enclosure 101 through which fixing means 326 are inserted.

In the above embodiment, a section 203*a*, 203*b* of each portion 201*a*, 201*b* of the feed layer 202 is coupled to a section 111*a*, 111*b* of a different electronic device track 104*a*, 104*b*. However it is to be understood the two sections 111*a*, 111*b* can alternatively be part of a single electronic device track 104, as shown schematically in FIG. 1.

In the above embodiment, a second foam layer 222*a*, 222*b* is attached to each of the two outer side portions of the film layer respectively at step 22. Alternatively, a second foam layer 222*a*, 222*b* can be attached to the inner surface of each of the two blades of metal 450*a*, 450*b* respectively as shown in FIG. 14. Indeed, where a foam layer is secured in between the feed layer and a ground plane in the above embodiment, it can be secured to either the feed layer or the ground plane or both.

As an alternative to foam layers for separating the film layer from the ground planes and hold the film layer in position, air and mechanical spacers may be used.

The hole in the surface 210 of the antenna housing 206 is not necessary. Alternatively two openings can be provided in the surface 210, the two openings corresponding to the two openings 212*a*, 212*b* in the surface of the perpendicular section of the cover 220. In this case, the ground planes inside the electronic device enclosure 101 can be electrically coupled to the ground planes inside the antenna housing using alternative methods, for example, at least part of the surface 210 of the antenna housing 206 can be made of electrically conductive material and can be electrically coupled to the ground planes inside the antenna housing 206 by physical connection and coupled to the ground planes inside the electronic device enclosure 101 as described above.

The above embodiment relates to dual-polarized antennas. However, it is to be understood that single-polarized and other multi-polarized antennas can also be assembled using the above method. For example, for a single-polarized antenna, one portion of the film layer carrying one portion 201 of the feed layer 202 extends outside of the antenna housing 206 through one opening 212 in the perpendicular section of the cover 220. This portion 201 is then folded around the spacer 300 and coupled to one electronic device track 104 as described above. In this case, a blade of metal resembling one side surface of the U-shaped metal layer 400, as shown in FIG. 12, can be provided instead of the U-shaped metal layer 400. Furthermore, the U-shaped enclosure 208 may be V-shaped instead, supporting a middle portion of the film layer carrying the conductive antenna elements of the feed layer 202 and a side portion of the film layer carrying one feed network 230.

The above embodiments are to be understood as illustrative examples of the invention. Further embodiments of the invention are envisaged. For example, the metal components referred to above such as the blades of metal 404*a*, 404*b* and U-shaped metal layer 400 etc can be made of other electrically conductive material instead.

The two ground planes for the feed layer 202 within the antenna housing 206 may be provided by two blades of metal instead of the cover 220 and the enclosure 208 while the enclosure 208 and the cover 220 may be provided separately and may be made of non-electrically conductive material.

The spacer 300 may not be necessary for the invention if for example the plane of the PCB 106, and thus its corresponding ground plane 105, is oriented perpendicular to the plane of the surface 210. In such an arrangement the feed layer 202, together with its external ground plane 400, can extend outside of the antenna housing 206 and cooperate with the PCB ground plane 105 without being folded.

The part 205 of the feed layer 202 may be microstrip instead of triplate, in which case only one of the U-shaped metal layer 400 and the blade of metal 404 is needed for each polarization.

It is to be understood that any feature described in relation to any one embodiment may be used alone, or in combination with other features described, and may also be used in combination with one or more features of any other of the embodiments, or any combination of any other of the embodiments. Furthermore, equivalents and modifications not described above may also be employed without departing from the scope of the invention, which is defined in the accompanying claims.

The invention claimed is:

1. An antenna system, comprising:

an antenna comprising an antenna housing and a feed layer, wherein the antenna housing comprises a surface, wherein the surface comprises an opening;

a U-shaped enclosure, wherein the U-shaped enclosure comprises a continuous sheet of electrically conductive material, and wherein the feed layer is wrapped around an outer portion of the U-shaped enclosure; and an electronic device comprising an electronic device enclosure;

wherein a portion of the feed layer extends outside of the antenna housing through the opening and into the electronic device enclosure, and wherein the antenna housing surface opening connects to a surface of the electronic device enclosure.

2. The antenna system of claim 1, wherein the electronic device comprises an electrically conductive track, wherein the electrically conductive track is coupled to the feed layer of the antenna.

3. The antenna system of claim 2, wherein the electrically conductive track is coupled to the feed layer of the antenna by means of overlay coupling.

4. The antenna system of claim 3, wherein the overlay coupling comprises two dielectric substrates, wherein the feed layer is printed on a surface of a first dielectric substrate of the two dielectric substrates, and wherein the electrically conductive track is printed on a surface of a second dielectric substrate of the two dielectric substrates, wherein the two dielectric substrates are located such that a section of the feed layer is in registration with a section of the electrically conductive track.

5. The antenna system of claim 2, wherein the antenna comprises a ground plane for the feed layer within the antenna housing, and the electronic device comprises a ground plane for the electrically conductive track, wherein part of the portion of the feed layer extending outside of the antenna has a ground plane, wherein the ground plane is electrically coupled to both the ground plane of the antenna and the ground plane of the electronic device.

6. The antenna system of claim 1, wherein the feed layer is U-shaped.

7. The antenna system of claim 1, wherein the feed layer comprises an array of patch antenna elements printed on a dielectric substrate.

8. The antenna system of claim 1, wherein the antenna comprises one or more antenna elements on the feed layer in the antenna housing, wherein the feed layer has a feed network within the antenna housing connected to the one or more antenna elements, and wherein a portion of the feed network extends outside of the antenna housing through the opening into the electronic device enclosure, and is coupled to the electronic device.

9. An antenna system, comprising:

an electrically conductive enclosure and a feed layer thereon, wherein the feed layer comprises a first electrically conductive track;

an electronic device, the electronic device comprising a second electrically conductive track; and a first substrate coupled to the electronically conductive enclosure, wherein a section of the first electrically conductive track is in registration with a section of the second electrically conductive track to facilitate electromagnetic coupling therebetween; and a second substrate between at least a portion of the first electrically conductive track and the second electrically conductive track, wherein the second substrate comprises a dielectric material.

10. The antenna system of claim 9, further comprising:

an antenna housing, wherein the electrically conductive enclosure and the feed layer are located within the antenna housing.

11. The antenna system of claim 10, wherein the second electrically conductive track is located outside of the antenna housing.

12. The antenna system of claim 10, wherein the second electrically conductive track is located within the antenna housing.

13. The antenna system of claim 9, further comprising:

an electronic device enclosure, wherein the second electrically conductive track is located within the electronic device enclosure.

14. The antenna system of claim 9, wherein the section of the first electrically conductive track is printed on a surface of a first dielectric substrate, and the section of the second electrically conductive track is printed on a surface of a second dielectric substrate.

15. The antenna system of claim 9, wherein the first substrate comprises dielectric material, and wherein the first electrically conductive track is printed on a portion of the dielectric material.

16. The antenna system of claim 9, wherein the section of the second electrically conductive track is carried by a printed circuit board (PCB) comprising a ground plane, the ground plane functioning as a ground plane for the section of the first electrically conductive track and the section of the second electrically conductive track.

17. An antenna, comprising:

a first electrically conductive enclosure which provides a ground plane of the antenna;

a first non-electrically conductive cover comprising a portion covering at least part of a closed end of the first electrically conductive enclosure; and a first feed layer comprising a first conductive antenna element, wherein the first conductive antenna element is located between the first electrically conductive enclosure and the portion of the first non-electrically conductive cover;

wherein the first conductive antenna element and the portion of the first non-electrically conductive cover provide a first radiating element.

18. The antenna of claim 17, wherein the first conductive antenna element comprises a conductive patch antenna element.

19. The antenna of claim 17, further comprising a dielectric spacer between the closed end of the first electrically conductive enclosure and the first conductive antenna element.

20. The antenna of claim 17, wherein the first electrically conductive enclosure comprises a first side and a second side, wherein an end portion of the first side is joined to an end portion of the second side by the closed end of the first electrically conductive enclosure.

21. The antenna of claim 17, further comprising a dielectric spacer between the closed end of the first electrically conductive enclosure and the first conductive antenna element, wherein the dielectric spacer is arranged to separate the first feed layer from the closed end of the first electrically conductive enclosure by a distance greater than a distance between the first feed layer and a side of the first electrically conductive enclosure.

22. The antenna of claim 17, wherein the first electrically conductive enclosure comprises a first side and a second side, wherein an end portion of the first side is joined to an end portion of the second side by the closed end of the first electrically conductive enclosure, and wherein a first electrically conductive cover covers at least part of the first side of the first electrically conductive enclosure.

23. The antenna of claim 22, wherein the first feed layer is further located between the first electrically conductive enclosure and the first electrically conductive cover.

24. The antenna of claim 22, further comprising:

a second electrically conductive enclosure, wherein the second electrically conductive enclosure and the first electrically conductive enclosure are located on opposite sides of the first electrically conductive cover, wherein the first electrically conductive cover further covers at least part of a side of the second electrically conductive enclosure;

a second non-electrically conductive cover comprising a portion covering at least part of a closed end of the second electrically conductive enclosure; and a second feed layer located between the second electrically conductive enclosure and the portion of the second non-electrically conductive cover, the second feed layer comprising a second conductive antenna element;

wherein the second conductive antenna element and the portion of the second non-electrically conductive cover provide a second radiating element, and wherein at least part of the second radiating element is aligned with the closed end of the second electrically conductive enclosure.

25. The antenna of claim 22, further comprising:

a second electrically conductive cover covering at least part of the second side of the first electrically conductive enclosure, wherein the first feed layer comprises two electrically conductive tracks, a first of the two electrically conductive tracks extending between the first side of the first electrically conductive enclosure, wherein the first electrically conductive cover covers at least part of the first side of the first electrically conductive enclosure, and wherein a second of the two tracks extends between the second side of the first electrically conductive enclosure and the second electrically conductive cover.

26. The antenna of claim 17, wherein the first feed layer further comprises an electrically conductive track, and wherein the first feed layer is printed on a single substrate.

27. The antenna of claim 17, wherein the closed end of the first electrically conductive enclosure is provided by two sides.

28. The antenna of claim 17, wherein the first electrically conductive enclosure comprises two open sides.

29. The antenna of claim 17, wherein the first electrically conductive enclosure provides mechanical support for the first feed layer.

30. The antenna of claim 29, wherein the first conductive antenna element is supported spaced from the portion of the first electrically conductive enclosure.

31. The antenna of claim 17, wherein the first electrically conductive enclosure comprises a continuous sheet of electrically conductive material.

32. The antenna of claim 17, wherein the first non-electrically conductive cover and the first conductive antenna element together define a resonant frequency of the first antenna element.

* * * * *